US007297365B2

(12) United States Patent
Ishikawa et al.

(10) Patent No.: US 7,297,365 B2
(45) **Date of Patent: *Nov. 20, 2007**

(54) RECORDED MATTER, METHOD OF PRODUCING RECORDED MATTER, METHOD FOR IMPROVING IMAGE FASTNESS, IMAGE FASTNESS-IMPROVING AGENT, IMAGE FASTNESS IMPROVING KIT, DISPENSER, AND APPLICATOR

(75) Inventors: Takayuki Ishikawa, Kanagawa (JP); Keiichi Murai, Tokyo (JP); Hiroshi Tajika, Kanagawa (JP); Takao Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/116,341

(22) Filed: Apr. 28, 2005

(65) Prior Publication Data

US 2005/0191446 A1 Sep. 1, 2005

Related U.S. Application Data

(62) Division of application No. 10/023,874, filed on Dec. 21, 2001, now Pat. No. 7,008,671.

(30) Foreign Application Priority Data

Dec. 28, 2000 (JP) ..... 2000-401317

(51) Int. Cl.
*B41M 5/55* (2006.01)

(52) U.S. Cl. ..... 427/152; 347/105; 427/277; 427/355; 427/369; 428/32.34

(58) Field of Classification Search ..... 347/105; 427/152, 277, 355, 369; 428/32.34
See application file for complete search history.

(56) References Cited

U.S. PATENT DOCUMENTS

| | | | | |
|---|---|---|---|---|
| 4,202,870 | A | 5/1980 | Weber et al. | 423/630 |
| 4,242,271 | A | 12/1980 | Weber et al. | 260/448 AD |
| 4,248,852 | A | 2/1981 | Wakabayashi et al. | 423/626 |
| 5,004,928 | A | 4/1991 | Suzuki et al. | 250/559 |

(Continued)

FOREIGN PATENT DOCUMENTS

EP 0 976 571 A1 2/2000

(Continued)

*Primary Examiner*—Bruce H. Hess
(74) *Attorney, Agent, or Firm*—Fitzpatrick, Cella, Harper & Scinto

(57) ABSTRACT

A method of manufacturing a recorded matter having an ink-receiving layer of a porous structure. The ink-receiving layer has an image region where an image is formed with a coloring material. The method includes the steps of (i) applying an ink to the ink-receiving layer to obtain an image region where an image is formed with a coloring material contained in the ink, (ii) applying a liquid comprising a non-volatile liquid not dissolving the coloring material to the ink-receiving layer, and (iii) forming a portion in which all or substantially all of the coloring material distributed in a thickness direction of the ink-receiving layer is embedded in the non-volatile liquid by rubbing the non-volatile liquid after it is applied. The non-volatile liquid contains an ester of a saturated fatty acid and an alcohol.

18 Claims, 9 Drawing Sheets

U.S. PATENT DOCUMENTS

| | | | | |
|---|---|---|---|---|
| 5,041,328 | A | 8/1991 | Akiya et al. | 428/212 |
| 5,091,009 | A | 2/1992 | Nogami et al. | 106/287.1 |
| 5,221,497 | A | 6/1993 | Watanabe et al. | 252/313.2 |
| 5,462,787 | A | 10/1995 | Yamamoto et al. | 428/195 |
| 5,565,238 | A | 10/1996 | Yamamoto et al. | 427/146 |
| 5,922,625 | A | 7/1999 | Haruta et al. | 442/75 |
| 6,084,620 | A | 7/2000 | Morikawa et al. | 347/96 |
| 6,142,618 | A * | 11/2000 | Smith et al. | 347/85 |
| 6,502,935 | B1 | 1/2003 | Barcock et al. | 347/105 |
| 6,773,770 | B1 | 8/2004 | Sugiyama et al. | 428/32.34 |
| 7,008,671 | B2 * | 3/2006 | Ishikawa et al. | 427/152 |
| 2003/0054113 | A1 | 3/2003 | Suzuki et al. | 427/429 |

FOREIGN PATENT DOCUMENTS

| | | | |
|---|---|---|---|
| EP | 1 145 865 | A2 | 10/2001 |
| EP | 1 186 439 | A1 | 3/2002 |
| JP | 56-77154 | | 6/1981 |
| JP | 57-44605 | | 9/1982 |
| JP | 1-264879 | | 10/1989 |
| JP | 4-28232 | | 5/1992 |
| JP | 4-34512 | | 6/1992 |
| JP | 6-30951 | | 4/1994 |
| JP | 8-13569 | | 2/1996 |
| JP | 9-48180 | | 2/1997 |
| JP | 2881847 | | 2/1999 |
| JP | 2803134 | | 7/1999 |
| JP | 11-245504 | | 9/1999 |
| JP | 2000-43408 | | 2/2000 |
| JP | 200043406 | * | 2/2000 |
| JP | 2000052638 | * | 2/2000 |
| JP | 2000-79752 | | 3/2000 |
| JP | 2000079752 | * | 3/2000 |
| JP | 2000-229484 | | 8/2000 |
| JP | 2001-10222 | | 1/2001 |
| JP | 2001010222 | * | 1/2001 |
| JP | 2000-52638 | | 2/2002 |

* cited by examiner

RECORDED MATTER, METHOD OF PRODUCING RECORDED MATTER, METHOD FOR IMPROVING IMAGE FASTNESS, IMAGE FASTNESS-IMPROVING AGENT, IMAGE FASTNESS IMPROVING KIT, DISPENSER, AND APPLICATOR

This application is a divisional application of U.S. patent application Ser. No. 10/023,874, filed Dec. 21, 2001 now U.S. Pat. No. 7,008,671.

BACKGROUND OF THE INVENTION

1. Field of the Invention

The present invention relates to a technique to improve fastness of an image formed by an ink jet process in an ink-receiving layer having a porous structure.

2. Related Background Art

To obtain high quality print or image by ink jet recording, both of the ink composition and the recording medium have been improved. It is required for the formed image not only high image quality such as no bleeding and excellent color reproducibility, but also maintenance of the high image quality for a long period, that is, resistance to the deterioration caused by both solar and room light, and chemical substances in air such as nitrogen oxides, sulfur oxides, hydrogen sulfide, chlorine, ozone and ammonium. Physical strength is also required for the formed image, not to deteriorate the image quality with abrasion etc. during exhibition or storage in a photo album.

Ink jet-recording is a method that records letters and images by flying micro droplets of ink (recording liquid) by various action principles to attach them on a recording medium such as paper. This method has characteristics such as high speed-low noise operation, easy multicolor printing, flexibility in recording pattern, and no need of development. Thus, this method has been developing and spreading rapidly not only as printers but also as the output part of information instruments such as copiers, word processors, facsimiles, and plotters. Moreover, in recent years, high performance digital cameras, video cameras and scanners are being provided at a low price as well as personal computers, where ink-jet printers are getting used as a printer to output the information obtained by these instruments. On such a background, output of an image of quality as high as that of a silver salt photograph or multicolor print by a printing plate system is being required for the ink jet-recording system.

On the other hand, preservation properties comparable to a silver salt photograph are also getting required for images recorded by the ink-jet method. To improve preservation properties of the recorded image, ink compositions and recording media have been improved. Specifically, to improve light-fastness of the recorded image, Japanese Patent Publication No. 6-30951 discloses a recording medium containing a specific cationic compound, Japanese Patent Publication No. 4-28232 discloses a recording medium containing an amino alcohol as a light-fastness-improving agent, and Japanese Patent Publication No. 4-34512 and Japanese Patent Application Laid-Open No. 11-245504 disclose a recording medium containing a hindered amine compound as a light-fastness-improving agent. Japanese Patent Publication No. 8-13569 shows a relationship between ozone gas and color change (mainly black to brown) of the recorded image during indoor storage, disclosing that a silica-based pigment with suppressed surface activity is effective to prevent color change of images indoors.

SUMMARY OF THE INVENTION

Color fading phenomenon that occurs when a recorded image is displayed indoors varies depending on the circumstance, for example, the whole image may turn reddish or greenish or the unprinted part may yellow. Meanwhile, the cause factor includes not only light, but also complicated influences of factors such as various gases in air, temperature and moisture. Thus, a method comprehensively solving the image-fading problem is needed.

Meanwhile, a recording medium that enables formation of an image comparable to silver salt photograph (hereinafter referred to as photo-recording element) has a material constitution of high clearness in order to obtain excellent coloring ability of dyes. With such a photo-recording element, the following problem will arise: when it contains an additive in a large amount such as the light-fastness-improving agent as described above in order to improve preservation properties of the image, clearness of the recorded image is lowered so that the image quality. Thus, in order to provide image fastness to a photo-recording element, there is still a problem to be solved in the balance between image fastness and recording properties.

One object of the present invention is to provide a recorded matter formed by an ink jet-recording system having improved fastness of the image without lowering the image quality, and to provide a manufacturing method thereof. Another object of the present invention is to provide a method of improving the fastness of the recorded image suitably applicable to a recorded matter formed by a recording process such as an ink jet recording method where recording is carried out by attaching ink to the recording medium, without lowering image quality such as image density, color tone and resolution. Further, the present invention provides an image fastness-improving agent that can improve the fastness of an image formed by using a water-based ink on a recording medium having a porous ink-receiving layer.

Still another purpose of the present invention is to provide a kit, a dispenser and an applicator to improve image fastness.

According to one aspect of the present invention, there is provided a recorded matter having an ink-receiving layer of a porous structure, wherein the ink-receiving layer has an image region where an image is formed with a coloring material, wherein the image region has a portion in which all or substantially all of the coloring material distributing in a thickness direction of the ink-receiving layer is embedded in a non-volatile liquid which does not dissolve the coloring material.

According to another aspect of the present invention, there is provided a method of manufacturing a recorded matter having an ink-receiving layer of a porous structure, the ink-receiving layer having an image region where an image is formed with a coloring material, the method comprising the steps of:

(i) applying an ink to the ink-receiving layer to obtain an image region where an image is formed with a coloring material contained in the ink;

(ii) applying a liquid comprising a non-volatile liquid not dissolving the coloring material to the ink-receiving layer; and (iii) forming a portion in which all or substantially all of the coloring material distributing in a thickness direction of the ink-receiving layer is embedded in the non-volatile liquid.

According to still another aspect of the present invention, there is provided a method of improving image fastness of a recorded matter having an ink-receiving layer of a porous structure, the ink-receiving layer having an image region where an image is formed with a coloring material, the method comprising the step of forming in the image region a portion in which all or substantially all of the coloring material distributing in a thickness direction of the ink-receiving layer is embedded in a non-volatile liquid not dissolving the coloring material.

According to still another aspect of the present invention, there is provided another method of improving image fastness of a recorded matter having an ink-receiving layer of a porous structure, the ink-receiving layer having an image region where an image is formed with a coloring material, the method comprising the step of forming in the image region a portion in which all or substantially all of the coloring material distributing in a thickness direction of the ink-receiving layer is embedded in a non-volatile liquid not dissolving the coloring material, wherein the liquid contains at least one of a silicone oil and a hindered ester.

According to still another aspect of the present invention, there is provided an image-fastness improving agent for improving image fastness of a recorded matter having an ink-receiving layer of a porous structure, the ink-receiving layer having an image region where an image is formed with a coloring material, the agent mainly comprising a non-volatile liquid not dissolving the coloring material.

According to still another aspect of the present invention, there is provided a kit for improving image fastness of a recorded matter having an ink-receiving layer of a porous structure, the ink-receiving layer having a region where an image is formed with a coloring material, the kit comprising a container containing an image fastness-improving agent as described in the preceding paragraph and a member for performing at least one of wiping and polishing a surface of the ink-receiving layer after the liquid is supplied to the surface.

According to still another aspect of the present invention, there is provided a dispenser containing an image fastness-improving agent described above.

According to still another aspect of the present invention, there is provided an applicator for an image fastness-improving agent comprising a storage portion for storing the image fastness-improving agent as described above, and an application member of the image fastness-improving agent, wherein the storage portion and the application member are integrated such that the image fastness-improving agent in the storage portion can ooze from a surface of the application member.

According to still another aspect of the present invention, there is provided a method of improving fastness of an image formed on a recording medium having an ink-receiving layer of a porous structure by applying a coloring material to the ink-receiving layer by an ink-jet method, comprising the steps of:

(i) forming an image by applying the coloring material to the ink-receiving layer by the ink jet method;

(ii) applying an image fastness-improving agent mainly containing a nonvolatile substance being a liquid state at normal temperature and normal pressure and not dissolving the coloring material, to the ink-receiving layer having the image formed therein; and (iii) forming in the region having the image formed therein, a portion in which all or substantially all of the coloring material distributing in a thickness of the ink-receiving layer is embedded in the image fastness-improving agent.

According to still another aspect of the present invention, there is provided a kit for improving image fastness comprising a recording medium having an ink-receiving layer of a porous structure and an image fastness-improving agent as described above.

Such constitution can remarkably improve image fastness of a recorded matter having an image formed with water base ink on a recording medium having an ink-receiving layer (e.g., coated paper), especially, fastness to gas such as $NO_x$, $SO_x$ and ozone. In addition, the color tone of the image can be deepened according to the present invention. Japanese Laid-Open Patent Application No. 56-77154 recites filling of the space in an ink-jet sheet having a porous structure with a non-volatile substance, but nothing is disclosed about the specific technology according to the present invention.

BRIEF DESCRIPTION OF THE DRAWINGS

FIG. 2A is a schematic sectional view showing a state when an image fastness-improving agent is applied to an ink-receiving layer and FIG. 2B is a schematic sectional view showing a state when the fastness-improving agent has filled the space of the ink-receiving layer;

FIG. 4A is a schematic perspective view showing the applicator in use and FIG. 4B a schematic perspective view showing the applicator of which application part is protected by a cap for convenience of storage or carrying;

DETAILED DESCRIPTION OF THE INVENTION

A detailed description will be given with reference to a sectional view of a recorded matter of the present invention. As shown in FIG. 2B, the recorded matter of the invention is a recorded matter where an image region was formed with a coloring material 1009 adsorbed on fine particles 1005 present in an ink-receiving layer 1003 formed on the surface of a substrate 1000, and in the image region, all or substantially all of the coloring material 1009 is embedded in or covered with an agent for improving fastness of recorded image (hereinafter also referred to as the agent) 1001 in the thickness direction of the ink-receiving layer 1003, thereby fastness of the image region to which the agent was applied is improved. According to the present invention, the ink-receiving layer of the recorded matter is not limited to those containing fine particles so long as they have a porous structure.

The reason why the present invention can achieve extraordinary improvement in the color tone and gas resistance of the recorded matter formed with water-based ink on a recording medium having an ink-receiving layer is considered as follows.

Figure 1:
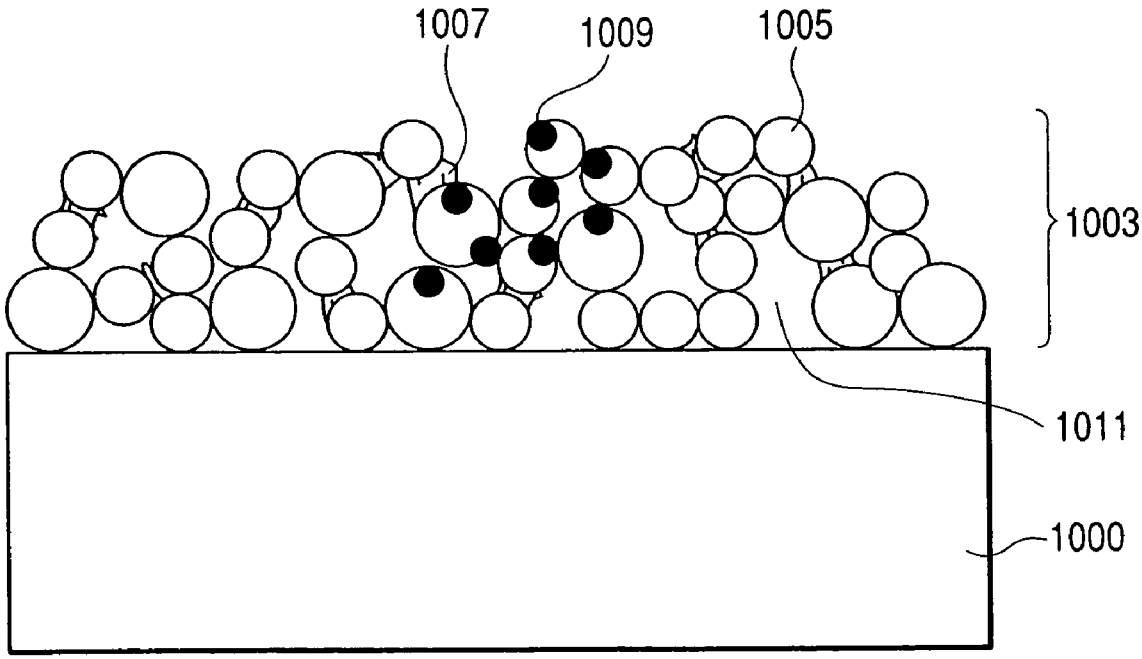
FIG. 1 schematically shows a sectional structure of a recording medium used in the present invention.

FIG. 1 shows a schematic sectional structure of so-called coated paper that has an ink-receiving layer having a porous structure comprised of fine particles formed on a substrate such as paper. In FIG. 1, reference numeral 1000 denotes a substrate; reference numeral 1003 denotes an ink-receiving layer supported by the substrate 1000. The ink-receiving layer 1003 has a porous structure made of fine particles 1005 bonded by a binding agent 1007. When ink droplets are applied to such coated paper and permeate into the ink-receiving layer 1003, the color material 1009 contained in the ink adsorbs to the surface of fine particles 1005 to form an image.

Figure 2A:
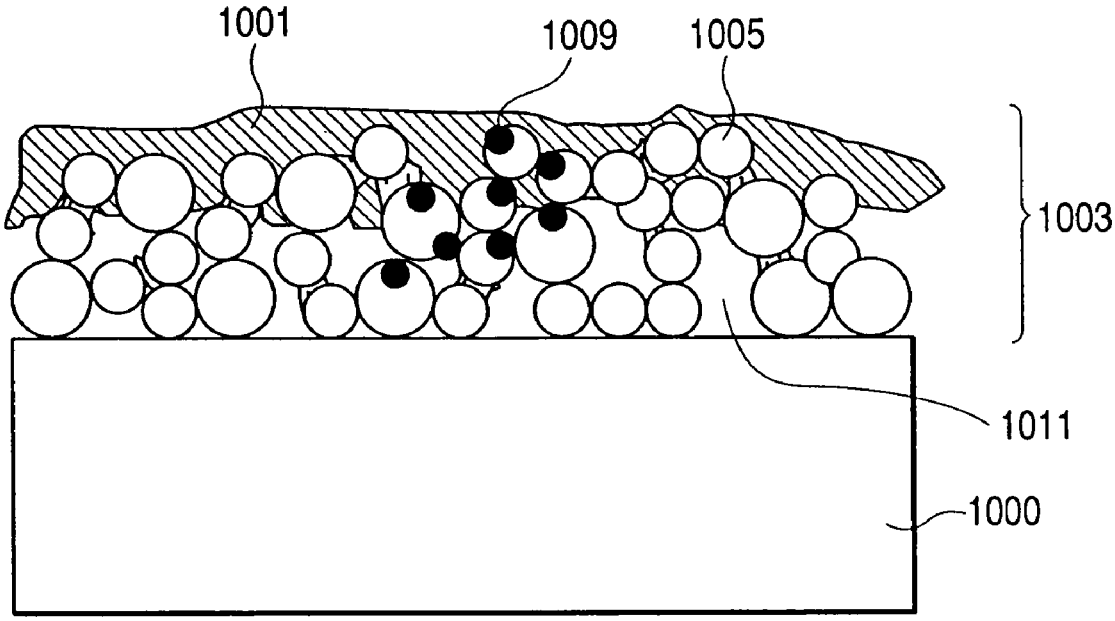
FIGS. 2A and 2B schematically illustrate a method for improving image fastness according to the present invention.
Figure 2B:
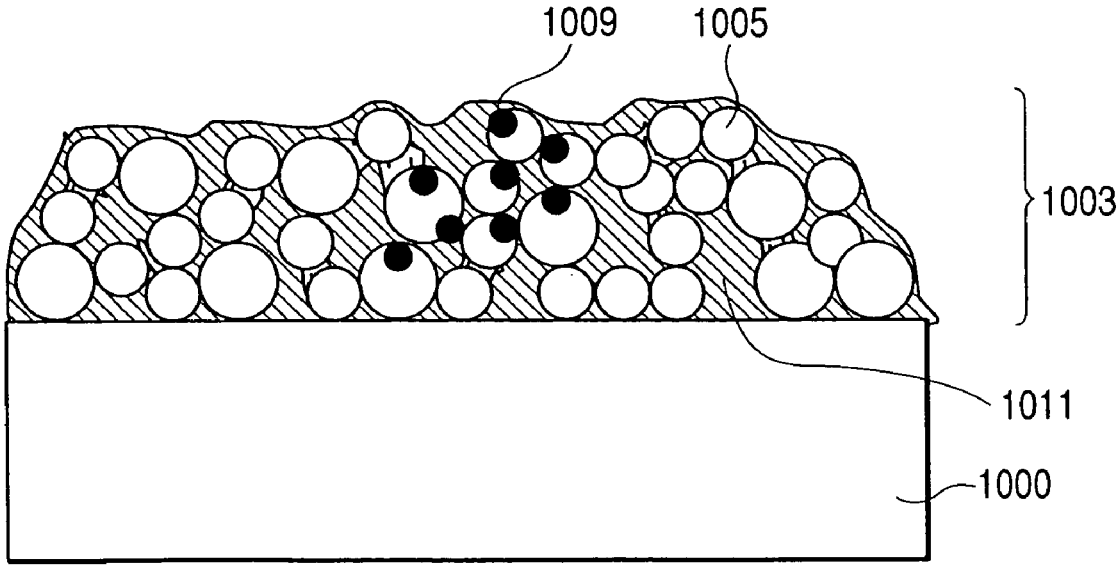

As shown in FIG. 2A, by mere application of the agent 1001 to the surface of the coated paper where recording has been done as described above, all of the coloring material distributing in the thickness direction of the ink-receiving layer may not covered with the agent. Thus, in order to cover all the coloring material distributing rather deep in the ink-receiving layer, a rubbing process is carried out after the agent was applied to fill the pores of the ink-receiving layer 1003, i.e., the pore space 1011 between fine particles 1005 with the agent. Since the agent is not aqueous, it gradually replaces the aqueous medium of the water-based ink trapped between particles and covers the coloring material adsorbed to the surface of fine particles. Subsequently, as shown in FIG. 2B, the space 1011 is filled with the agent 1001 and all or substantially all of the coloring material distributing in the thickness direction of the ink-receiving layer is in the agent, thereby, the coloring material 1009 is insulated from gases such as SOx, and NOx, in air or in moisture containing them. As a result, deterioration of the coloring material in the ink-receiving layer is blocked and fastness of the image is improved. Other advantages according to the present invention than the fastness improvement, such as improvement in chroma, print density and glossiness, are considered as follows: irregular reflection of light at the surface and inside of the ink-receiving layer occurs due to the difference in the refraction indices between the material constituting the ink-receiving layer and gas in the pore space, here, fine particles and air. The agent presumably suppresses such irregular refraction by filling the pore space.

Japanese Patent Application Laid-Open No. 9-48180 discloses that covering a print of a water-base ink with silicone oil and the like improves water resistance, but it does not disclose or suggest application of such a protecting agent to a printed matter formed on a recording medium having a porous structured ink-receiving layer or the effect of such application. Further, according to the inventors' examination, mere covering of the printed matter would not provide sufficient image fastness that is an aim of the present invention. This is considered that there remains pore space not filled with the agent in the ink-receiving layer, where the coloring material deteriorates. It has been observed that when only the surface of the recorded matter is covered with the agent, gas and moisture remain in the pore space, as a result, the image deteriorates gradually from around the pore space. This also supports the theory that in the present invention the surface of the coloring material in the ink-receiving layer is fully covered with the agent to be insulated from air and moisture, bringing about improved gas resistance, an advantage of the present invention. In other words, it is essential for the present invention to supply the agent in an amount sufficient to cover the coloring material distributing in the thickness direction of the ink-receiving layer, and to fill the pore space sufficiently with the agent by rubbing treatment etc. Mere application of the agent to the surface of the recorded matter by spray or coating to cover the surface of the ink-receiving layer is difficult to obtain the advantage of the present invention such as improved chroma and enhanced gas resistance without fail. In the present invention, more preferably, all or substantially all the pore space in the thickness direction of the ink-receiving layer is filled with the agent to prevent remaining air and moisture in the ink-receiving layer. In this case, needless to say, all or substantially all of the coloring material distributing in the thickness direction of the ink-receiving layer is covered or embedded in the agent.

In the present invention, the agent is applied to the ink-receiving layer in a state of liquid. Thus, it can penetrate easily into the ink-receiving layer and can change shape along the porous structure of the ink-receiving layer for full exertion of the effect of the present invention. Moreover, as it is held as a liquid in the ink-receiving layer, when the recorded matter is deformed to an allowable extent, the contact state between the agent and the inner wall of the porous structure or the surface of the fine particles forming the porous structure can be maintained in a good condition.

On the other hand, when the agent is in a solid state at ordinary temperature like a wax, there arises a problem that penetration into the ink-receiving layer requires pressure application or it is hard to obtain uniform penetration. In addition, when the agent is applied as a dilution in a volatile solvent and then solidified, or it is a liquid when applied but it contains a component that solidify afterward, whiting may occur in the agent due to the intake of moisture or air bubbles during solidification. Further, if volume reduction occurs during solidification, gap is formed between the agent and the porous structure, so that the color material-protecting function may lower. The agent of the present invention is applied to and held in the ink-receiving layer in a liquid state to avoid the above disadvantages of solid or solidifying agents. That the agent is in a liquid state in the ink-receiving layer can be confirmed by checking there is no thermal (endothermic or exothermic) behavior in solution by, for example, carrying out the local thermal analysis of the ink-receiving layer.

The rubbing treatment in the present invention means at least one of wiping and polishing to fill the pore space of the ink-receiving layer with the agent.

A sectional structure of a printed matter where the effect of the invention is sufficiently developed was observed by using SEM, where the ink-receiving layer of the printed matter was made of fine particles, and the agent had been colored with a proper dye to recognize the permeation front. As a result, the agent permeated to the full depth of the ink-receiving layer to fill every pore space between fine particles, and all of the coloring material was in the agent.

This result also indicates the importance of positive filling of the pore space of the ink-receiving layer with the agent not mere covering of the ink-receiving layer.

Each constitutional element usable for the present invention will be described below.

A: Image Fastness-improving Agent

The image fastness-improving agent (the agent) according to the present invention varies according to the kind of the coloring material used to form the image. Here is described, as an example, an image fastness-improving agent usable for an image formed with a water-based ink, a popular ink jet ink containing a water soluble dye. The image fastness-improving agent used in the present invention is preferably a non-volatile material that is in liquid state at ordinary temperature (15 to 30° C.) and pressure, and does not dissolve hydrophilic coloring materials. However, so long as the effect of the present invention is achieved, the agent may mainly contain the non-volatile material described above and additionally other substances. Specific examples of a non-volatile material preferably used as the image fastness-improving agent include silicone oils, fatty acid esters and hindered amines. In addition, use of such an image fastness-improving agent provides glossiness to the surface of the ink-receiving layer, yielding a visually more preferable recorded matter. Here, a non-volatile material is defined as follows: when 50 g of a substance is put in a 100 ml sample jar of 4.5 cm diameter and left at 100° C. for 300 hours with heating in an open system, if the weight change is not larger than 0.5%, the substance is non-volatile. When a recorded matter treated with such a non-volatile material according to the present invention was left standing in a thermostat at 80° C. for 5 hours, almost no change was observed.

A-a: Silicone Oil

Silicone oil usable as the image fastness-improving agent according to the present invention includes for example, straight silicone oil represented by dimethyl silicone oil and an organic modified silicone oil represented by alkyl-modified silicone oil. Particularly preferable silicone oil is expressed by the following structural formula (1).

(1)

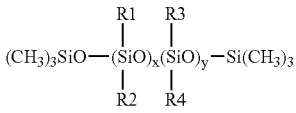

In the above formula (1), R1, R2, R3, and R4 are independently selected from the group consisting of phenyl, substituted or unsubstituted alkyl, functional substituents having UV absorbency or antioxidant ability. The alkyl group is exemplified by a straight or branched alkyl group having 1 to 20 carbons. At least one hydrogen atom of the alkyl group may be substituted by, for example, a halogen atom (F, Cl, Br etc.), a primary or secondary amino group, and the like. The functional substituent having UV absorbency or antioxidant ability is, for example, composed of a linker selected from general formulae (17) to (19) having a substituent selected from general formulae (20) to (22) linked at the free end.

(Linker)

(17)

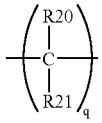

(18)

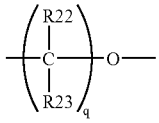

(19)

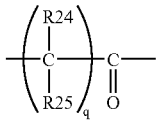

wherein R20 to R25 are each selected from the group consisting of a hydrogen atom, a straight or branched alkyl group of C1 to C20, a halogen atom, and an amino group, where at least one hydrogen atom of the alkyl group may be substituted by, for example, a halogen atom (a fluorine atom, a chlorine atom, a bromine atom etc.), or a primary or a secondary amino group, and q is an integer of 1 to 20.

(Substituent)

(20)

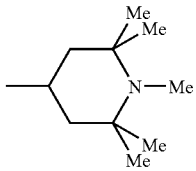

(21)

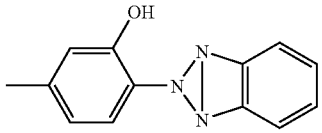

(22)

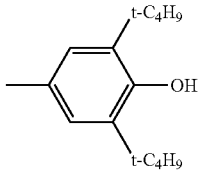

In the above described formula, Me and t-$C_4H_9$ represent methyl and tert-butyl respectively.

In the general formula (1), x and y are independently 0 or a positive integer and suitably selected to give the later described preferable viscosity to the agent or non-volatile liquid, with proviso that x and y are not 0 at the same time. Among the above described silicone oils of the general formula (1), in view of easy handling and fastness-improving effect, dimethyl silicone oil, fluorine-modified silicone oil having fluoroalkyl side chains, alkyl-modified silicone oil having alkyl in side chains, and amino-modified silicone oil having primary amine in side chains are preferably used, most preferably, fluorine-modified silicone oil expressed by the following formula (2) and alkyl-modified silicone oil expressed by the following formula (23).

(2)

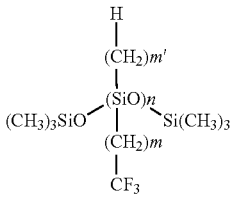

In the above formula (2), n is an integer of 50 to 600 and m and m' are each independently an integer of 1 to 20.

(23)

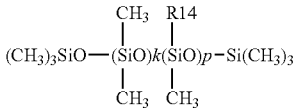

In the formula (23), R14 represents substituted or unsubstituted alkyl group and k and p are each independently an positive integer, where the alkyl group is a straight or branched alkyl group of 1 to 20 carbon numbers, of which at least one hydrogen atom may be substituted by a halogen atom (fluorine, chlorine, bromine etc.), or a primary or secondary amino group.

It is not clear why such modified silicone oil can improve the image fastness very effectively. The inventor, however, have found that water repellency of the ink receiving layer of which pore space was filled with such a silicone oil is high in comparison with ordinary silicone oil. Thus, they consider that after such-modified silicone oil is filled in the pore space of the ink-receiving layer, penetration of water into the receiving layer can be effectively prevented so that contact between the coloring material in the agent and water molecules are prevented further.

A-b: Silicone Resolvent

Silicone oil usable as the fastness-improving agent generally has a low solubility to various solvents; however, use of a silicon resolvent containing a branched monoester expressed by the following structural formula (3) can solve this problem. When other additives (a hindered amine, an ultraviolet light absorbent, or an antioxidant) are in a form of an oil-soluble powder, addition of this silicon resolvent can dissolve them in the silicone oil as a uniform liquid. Therefore, it widens the selection range for materials to be used in the agent.

(3)

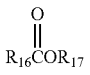

(In the formula (3), R16 represents a branched alkyl group having a carbon number of 5 to 18 and R17 represents a branched alkyl group having a carbon number of 3 to 18).

A-c: Fatty Acid Ester

Another material usable as the image fastness-improving agent is a fatty acid ester. A preferable ester can be yielded from a saturated fatty acid having a carbon number of 5 to 18 and an alcohol having a carbon number of 2 to 30. Among them, in consideration of easy handling and effect of fastness improvement, esters prepared from a saturated fatty acid exemplified by caprylic acid, capric acid, lauric acid, myristic acid, palmitic acid, stearic acid, isononanoic acid, isostearic acid, and 2-ethyl hexanoic acid, and a bulky polyol represented by neopentyl polyol, or esters prepared from a polyvalent saturated fatty acid represented by adipic acid and an alcohol are more preferable, and particularly, hindered esters expressed by the following structural formulae (4) and (5), and esters of a saturated fatty acid having a carbon number of 8 and 10 and trimethylol propanol are preferable. More preferably, the agent contains hindered esters expressed by the structural formulae (4) and (5), still more preferably, hindered esters expressed by the following structural formulae (4) and (5) are contained and the ester of formula (4) is contained at 50% or more of the total weight of the agent.

It is not clear why such fatty acid esters can improve image fastness. The inventors considers as follows; filling of the pore space of the ink-receiving layer with the agent containing such a fatty acid ester, gas permeability of the ink-receiving layer becomes low, which suppresses contact between gas (air etc.) and the coloring material in the agent, providing improved fastness of the image. Particularly, use of the hindered ester brings about remarkable effect of fastness-improvement. Further, hindered esters are suitably used because they have high thermal stability and are resistant to hydrolysis in comparison with normal esters.

(4)

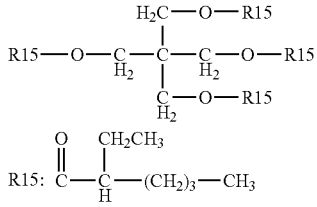

(5)

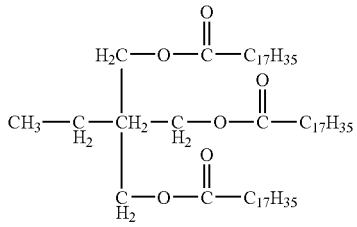

A-d: Hindered Amine Compounds

Another material suitably used as the image fastness improving agent is a hindered amine compound having antioxidant and light-stable effect. Hindered amine compounds having at least one substituent expressed by the following structural formula (6) are preferably used, especially, an ester of tetracarboxylic acid as expressed by the following formula (7), a polyglycerin ester having a hindered amine unit, a saturated fatty acid ester having a hindered amine unit, polyorganosiloxane having a hindered amine unit are preferably used.

(6)

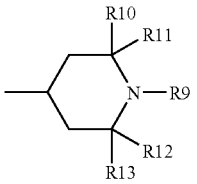

In the above formula (6), R9 is H or an alkyl group, preferably of a carbon number of 1 to 8. R10 to R13 are each H or an alkyl group, preferably a carbon number of 1 to 3.

(7)

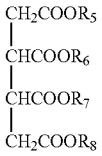

In the above formula (7), at least one of R5 to R8 is the group expressed by the above formula (6) and others are a hydrogen atom or a monovalent organic residue. The monovalent organic residue includes an alkyl group of 1 to 20 carbons or a substituent expressed by the following formula (8).

When R5 to R8 in the above formula (7) are a group expressed by the above described formula (6) or an alkyl group of C13 to contain at least one of each, and R9 in the formula (6) is a methyl group, such a compound is liquid, and preferable in consideration of workability and efficiency in applying the agent to the recording medium and in filling the pore space in the ink-receiving layer with the agent for sure.

Those having two or more groups represented by the above formula (6) are more preferably used and an exemplary compound is expressed by the following formula (8).

(8)

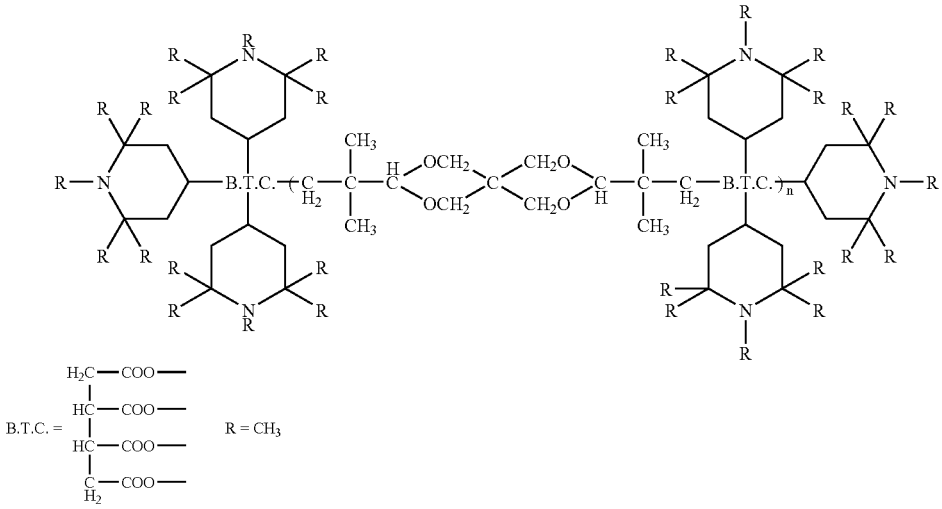

It is not clear why hindered amine filled in the pore space of the ink-receiving layer can enhance the image fastness, but the inventors consider that not only hindered amine captures radicals produced by light and oxidation deterioration to prevent deterioration of the coloring material, but also molecules of the coloring material surrounded by the bulky hindered amine are not subject to chemical attacks. Although in the art of the ink-jet recording medium, it is known to make the ink-receiving layer contain hindered amine, its effect on image fastness is far inferior to the effect of the present invention where a non-volatile liquid that contains a hindered amine compound and does not dissolve the coloring material is applied after the image formation to cover every coloring material with the liquid to the full depth of the ink receiving layer. And, in the present invention, when the liquid containing hindered amine compound in addition to silicone oil and fatty acid ester is used, the effect of blocking the coloring material from air or moisture by the silicone oil and fatty acid ester, and the effect of suppressing the chemical attack of the coloring material by bulky hindered amine may work synergistically.

Here, liquid hindered amine is more preferably used but powder hindered amine may be used by dissolving or diluting it with a solvent that is incompatible with the ink or coloring material, in order to improve workability and/or filling into the pore space. In this case, it is preferable to use silicone oil or saturated fatty acid ester as described above as the solvent. The a hindered amine compound is preferably added in a weight ratio of:, silicone oil or saturated fatty acid ester:hindered amine compound=100:1 to 1:100, more preferably, 9:1 to 5:5.

The image fastness-improving agent used for the present invention may contain one of the above-described substances, or may contain more than one substances so long as they have affinity each other. In this case, they can belong to different groups such as silicone oil and a saturated fatty acid ester.

Moreover, the image fastness-improving agent of the invention can contain additives soluble or evenly dispersible in the above non-volatile liquid. For example, an antioxidant, a light-stabilizer, a radical quenching agent, an ultraviolet absorbent, a thickening agent, a fragrance, a polish, an agent having pharmacological effect such as a disinfectant and an insecticide can be contained as an additive.

It is preferred to use hindered amines, hindered phenols, and vitamins as the antioxidant and light-stabilizer, stabilized radicals as the radical quenching agent, phenyl salicylates, hindered phenyls, benzotriazoles and benzophenones as the ultraviolet absorbent. Additives such as thickening agents, fragrance, polish, and pharmacologically active agents, e.g., disinfectants and insecticides are added properly for further functions. If additives are contained, the liquid component being the effective component of the image fastness-improving agent functions as a solvent or dispersion medium for these additives. If these additives are not sufficiently soluble in the agent or they are volatile, or they are dispersed in a rough particle condition, application of the agent causes deterioration of image quality and the reduced image fastness. Therefore, it is most preferable to select materials being liquid at ordinary temperature and pressure, and having nearly the same specific gravity as the silicone oil or the fatty acid ester, or completely soluble only in these effective components. However, so long as the effect of the present invention can be achieved, the additive can be added without any special limitation.

Preferable additives will be described below.

A-e. Ultraviolet Absorbent

The ultraviolet absorbent to be added to the agent as described above is exemplified by those, which is expressed by the following structural formulae (9) to (16).

(9)

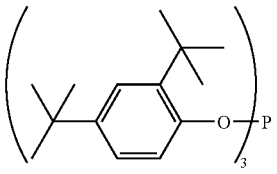

(10)

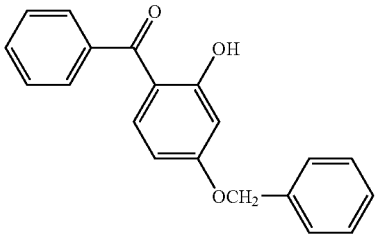

(11)

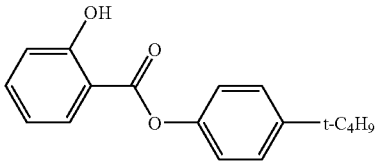

(12)

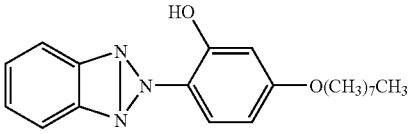

(13)

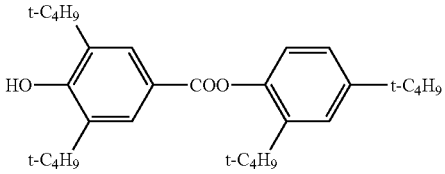

-continued (14)

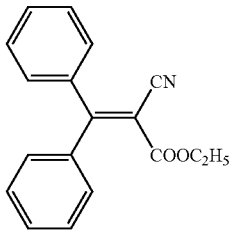

(15)

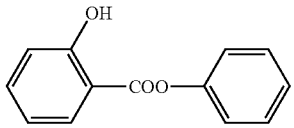

(16)

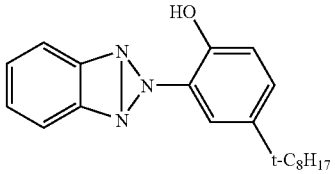

In the above formulae, t-$C_4H_9$ and t-$C_8H_{17}$ represent a tert-butyl group and a tert-octyl group, respectively.

A-f: Thickening Agent

The thickening agent to be added to the image fastness-improving agent according to the present invention is, for example, exemplified by compounds, which is expressed by the following structural formulae (24).

(24)

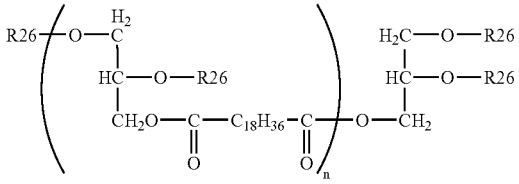

In the above formulae, R26 represents behenic group (—CO—$(CH_2)_{20}$—$CH_3$) or a hydrogen atom.

Figure 4A:
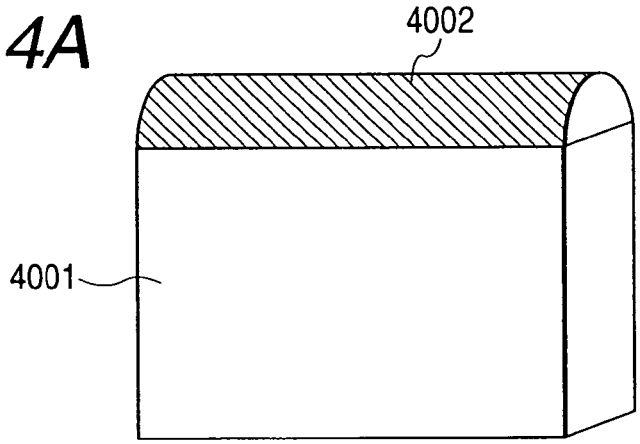
FIGS. 4A and 4B show an applicator according to the present invention.
Figure 4B:
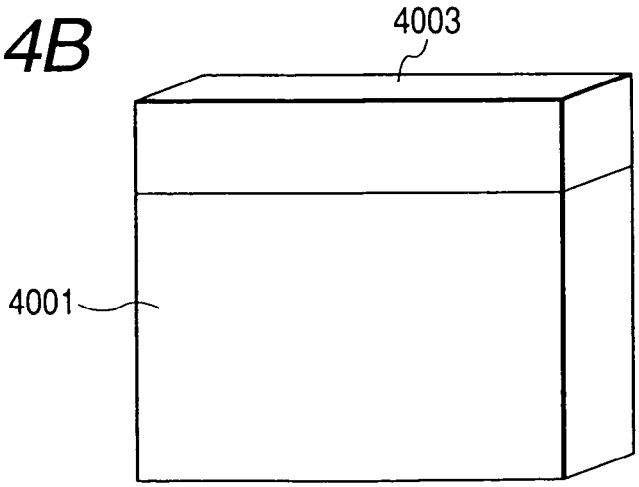
Figure 5:
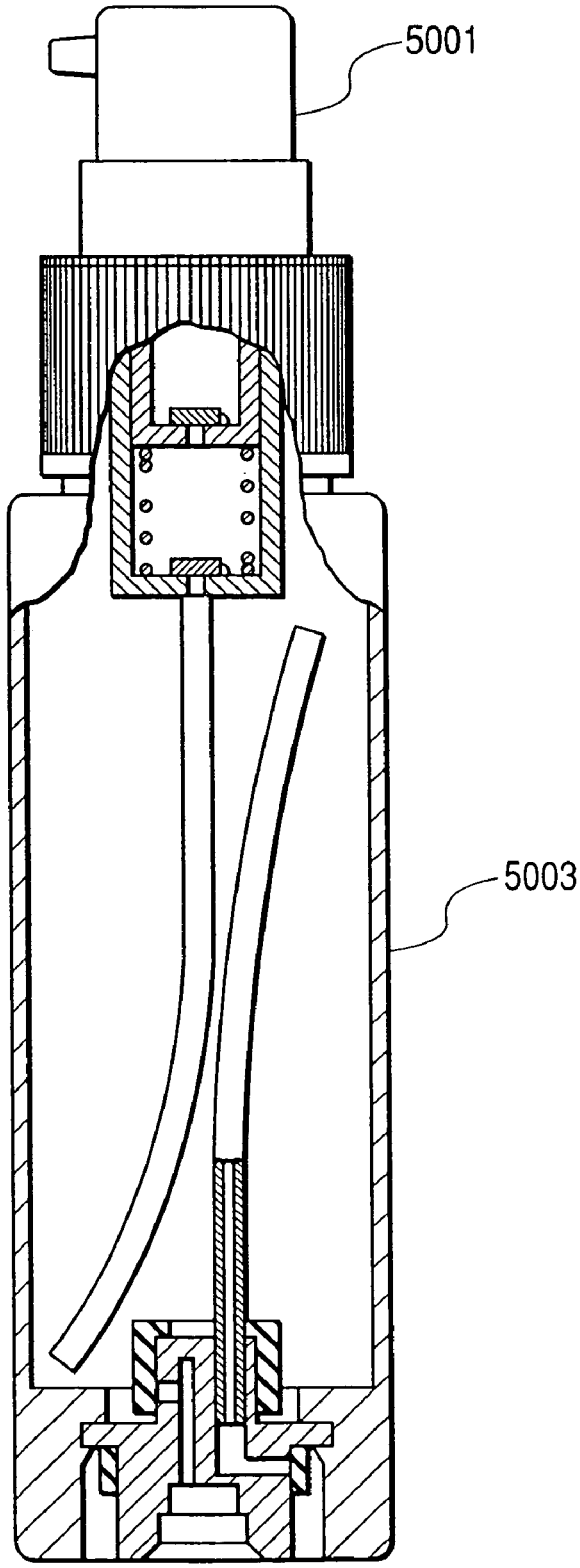
FIG. 5 is a schematic sectional view of an atomizer according to the present invention.
Figure 6:
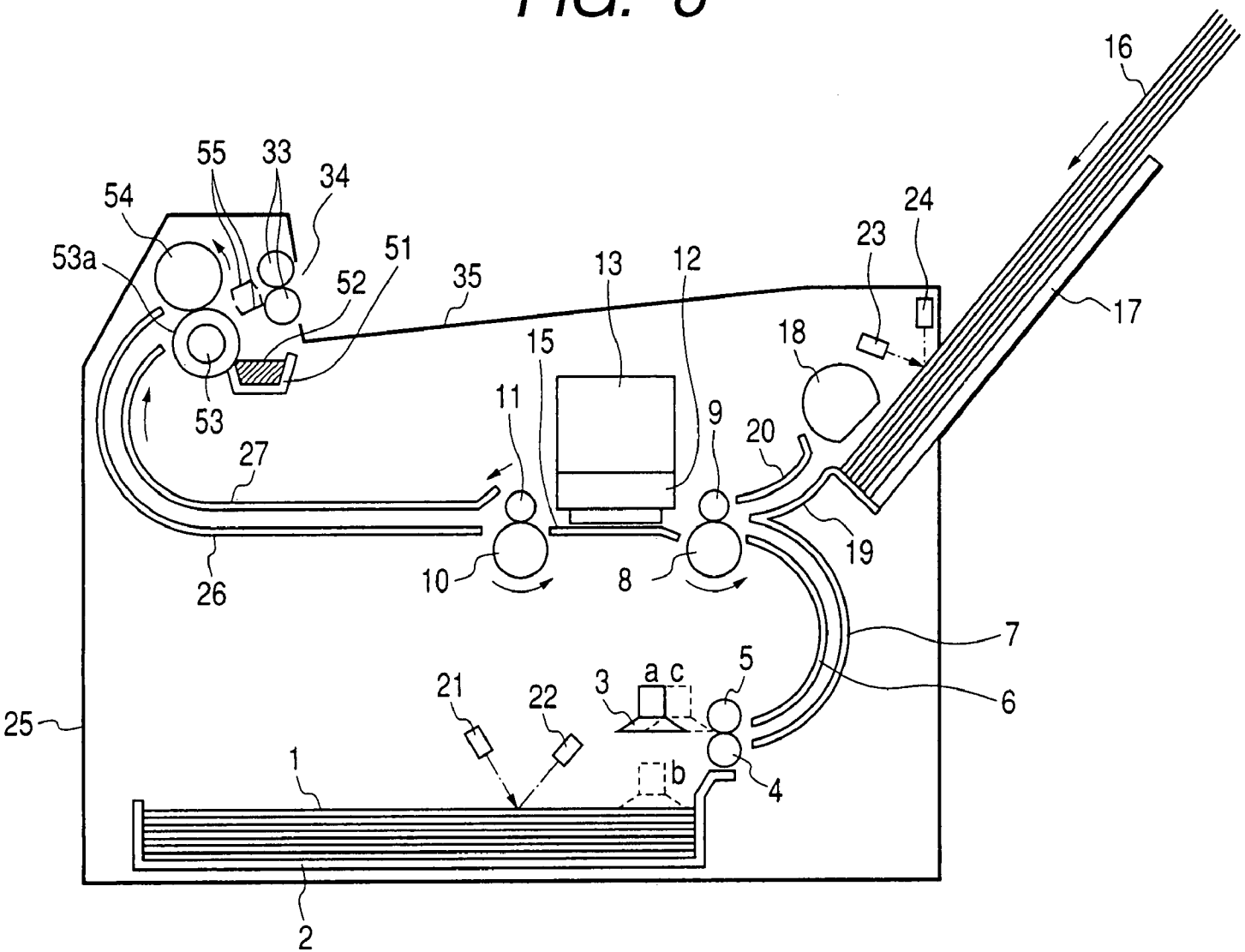
FIG. 6 is a schematic sectional view of an ink jet recording apparatus according to the present invention.

Dynamic viscosity of the agent at application to the recording medium is preferably from 50 cs to 600 cs under the conditions of application and rubbing steps, in view of prevention of strike-through and the filling and fixation performance in the pore space of the ink-receiving layer when applied to the recording medium. When the agent is applied by using a tool as shown in FIGS. 4A, 4B and 5, it is preferable that the dynamic viscosity ranges from 100 to 400 cs and more preferably, from 200 cs to 400 cs. When the agent is applied by using an instrument as shown in FIG. 6, the dynamic viscosity ranges preferably from 50 to 200 cs. Meanwhile, after the agent was applied to the recording medium, it is preferable that the dynamic viscosity of the agent is from 150 to 300 cs in order to prevent migration and increase the maintenance stability of the agent in the pore space. The dynamic viscosity was measured according to JISK-2283.

A preferable surface tension of the image fastness improving agent according to the present invention is 20 to 30 mN/m in consideration of easy filling in and less oozing from the ink-receiving layer. In addition, the agent should have a melting point and a boiling point such that the agent is liquid at ordinary temperature and pressure. Further, in consideration of clearness in the recording medium, the refraction index (at 25° C.) ranges preferably from 1.3 to 1.5; and in consideration of smooth penetration and fixation in the ink-receiving layer of the recording medium, the specific gravity ranges preferably from 0.95 to 1.4.

Another advantage of the image fastness-improving agent is to enhance glossiness of the surface of the ink-receiving layer, to provide a recorded matter of visually higher quality.

B: Recording Medium

As the recording medium usable for the present invention, any recording medium can be used so long as it has a porous ink-receiving layer to which ink is attached for recording. In the present invention, however, it is preferable that the medium does not cause strike-through, since the agent such as silicone oil and fatty acid ester is impregnated in the recording medium. In the present invention, the following recording medium is particularly preferable when recording is carried out by ink jet process: a recording medium having a porous structured ink-receiving layer formed from fine particles that adsorb the coloring material. The recording medium is preferably so-called "absorption type" that absorbs ink in the pore space in the ink receiving layer formed on the substrate. Such an ink-receiving layer made of fine particles has a porous structure, containing, if necessary, a binder and other additives. Fine particles are exemplified by silica, clay, talk, calcium carbonate, kaolin, aluminum oxide such as alumina or alumina hydrate, inorganic matters such as diatomite, titanium oxide, hydrotalcite and zinc oxide, and organic matters such as urea formalin resins, ethylene resins, and styrene resins, or combinations thereof. Those preferably used as the binder are exemplified by a water soluble high polymer and latex. For example, polyvinyl alcohol or a-modified material thereof, starch or-modified material thereof, gelatin or-modified material thereof, gum arabic, a cellulose derivative such as carboxymethyl cellulose, hydroxyethyl cellulose, hydroxypropylmethyl, and the like cellulose, vinyl-based copolymer latex such as SBR latex, NBR latex, methylmethacrylate-butadiene copolymer latex, a functional group-modified polymer latex, ethylene acetic acid vinyl copolymer, polyvinyl pyrrolidon, maleic acid anhydride and copolymer thereof, acrylic acid ester copolymer are used and if necessary, 2 or more species can be used in combination. Moreover, additives can be used. For example, if necessary, dispersant, thickening agent, pH adjuster, lubricant, fluid denaturant, surfactant, antifoam agent, release agent, fluorescent whitener, ultraviolet absorbent, antioxidant, and the like are used.

Particularly preferable recording medium according to the present invention has an ink-receiving layer formed from the above-described fine particles of which average pmatter diameter is not larger than 1 μm. Specifically preferred such fine particles are silica or aluminum oxide fine particles. The reason why the effect of the present invention is remarkable with such fine particles is not clear, but considered as follows. It is known to the inventors that the coloring material adsorbed to aluminum oxide or silica fine particles are subject to fading caused by gas such as NOx, Sox and ozone. These fine particles are liable to attract gas, so that the coloring material is liable to be faded by gas in the vicinity of the coloring material. Fine particles of silica are represented by colloidal silica. Although colloidal silica is commercially abailale, it is preferable to use those described in Japanese Patent Nos. 2803134 and 2881847. Preferable aluminum oxide fine particles are fine particles of alumina hydrate. One suitable alumina hydrate is exemplified by the following general formula (25).

$$Al_2O_{3-n}(OH)_{2n}.mH_2O \quad (25)$$

In the above formula (25), n represents an integer of 1, 2, or 3 and m represents a figure of 0 to 10, preferably, a figure of 0 to 5, with proviso that and m and n are not 0 at the same time. As $mH_2O$ represents, in many cases, releasable water not participating in $H_2O$ crystal lattice, m can be an integer or not. Meanwhile, m may become 0 when such a material is heated. It is preferred to use an alumina hydrate prepared by hydrolysis of aluminum alkoxide or sodium aluminate as described in U.S. Pat. Nos. 4,242,271 and 4,202,870 respectively, or by neutralization of a solution of sodium aluminate with a solution of sodium sulfate or aluminum chloride as described in Japanese Patent Publication No. 57-44605.

Moreover, the ink-jet recording medium prepared by using such an alumina hydrate is excellent in affinity to, absorbency of, and fixation of the agent according to the present invention. In addition, such a recording medium is excellent in glossiness, clearness, and fixing ability of the coloring material such as a dye in the ink, which are required for realizing the photographic image quality. Thus, it is preferable to be used in the present invention. The mixing ratio of the fine particles and a binder is preferably from 1:1 to 100:1 by weight in such an ink-jet recording medium employed in the present invention. If the amount of the binder is in this range, the volume of the pore space can be maintained to be suitable for impregnation of the image agent to the ink-receiving layer. A preferable content of the aluminium oxide fine particles or silica fine particles in the ink-receiving layer is 50% by weight or more, more preferably 70% or more, and further preferably 80% or more, the most preferably not more than 99%. The application amount of the ink-receiving layer is preferably 10 $g/m^2$ or more and most preferably 10 to 30 $g/m^2$ by dry weight to achieve sufficient impregnation with the image fastness-improving agent.

Figure 3:
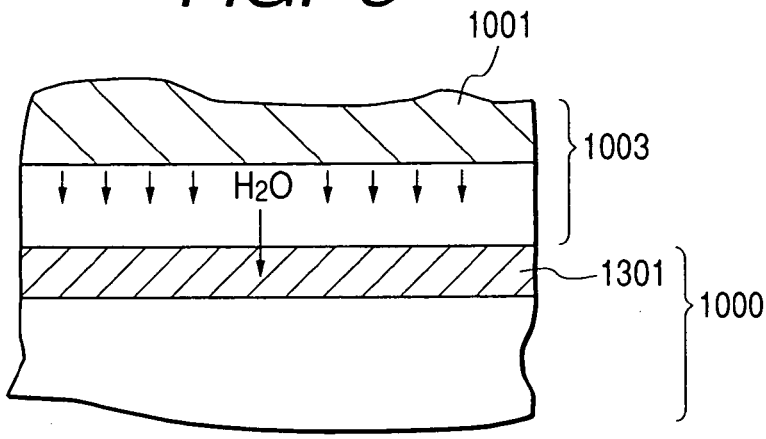
FIG. 3 is an illustrative view of behavior of water molecules in the ink-receiving layer having a dense porous layer on the surface where the ink-receiving layer is formed on a substrate of the recording medium.

It is preferable for the recording medium used for the present invention to have a substrate to support the above-described ink-receiving layer. The substrate is not specially limited and any can be used so long as the ink-receiving layer having the porous structure as described above can be formed thereon, and it has a rigidity suitable to be carried by a carrying system of an ink jet printer etc. More preferable recording medium includes those having the ink receiving layer provided on size paper or on a substrate such as baryta paper that has a porous layer denser than the ink-receiving layer formed by applying an inorganic pigment such as barium sulfate together with a binder on the surface of the fibrous substrate. Such a recording medium can bring about more advantage for the recorded matter of the present invention having a recorded region where all or substantially all pore space existing in the thickness direction of the ink-receiving layer is filled with the agent. In other words, when such a recorded matter is left in an environment of high temperature and high humidity for a long period, surface stickiness due to the oozing of the agent to the surface can be effectively inhibited, giving a recorded matter excellent in preservation. The mechanism of the above effect is not clear, but considered as follows: because the applied agent has difficulty in passing through the dense and low-in gas permeability layer such as the baryta layer, so that the agent fills the pore space for sure. In addition, air and moisture existing in the pore space of the ink-receiving layer is moved to or adsorbed by the dense porous layer 1301 as shown diagrammatically in FIG. 3, during the process of filling of the pore space with the agent. As a result, air and moisture will not remain in the ink-receiving layer, or remain in a reduce amount, if any.

This presumption is supported by the following experimental fact. When the method of the invention was carried out using a recording medium where the ink receiving layer was provided on a substrate of a plastic sheet having no gas permeability or water absorbency, certain effect was obtained, but when the recorded matter was kept under high temperature and high humidity conditions, oozing of the agent to the surface of the ink-receiving layer was observed.

As a recording medium having a porous structure on the surface, applicable to the present invention, in addition to the above-described recording media having a porous ink-receiving layer formed on a substrate, anodized aluminum can be used.

C: Method for Manufacturing the Recorded Matter and Method for Improving Image Fastness (1) One embodiment of the method for manufacturing a recorded matter or method for improving image fastness of the present invention is as follows: first, an image such as letters and pictures is recorded by applying aqueous ink or droplets thereof onto a porous-structured ink-receiving layer of a recording sheet, and then, the agent described above is supplied to the surface of the ink-receiving layer followed by rubbing treatment. In this case, it is preferable to rub the agent into the entire surface of the recorded sheet, although it is possible to apply and rub the agent to part of the recording sheet. By this, the coloring material in the ink-receiving layer can be protected from the attack of gas such as $NO_x$, $SO_x$, and ozone without fail.

As already described, in a more preferable embodiment, all or substantially all pore space of the ink-receiving layer of the image region are filled with the agent to the full depth of the ink receiving region. In this case, in view of easiness of application, it is suitable to supply the agent in an amount sufficient to completely fill the pore space considering the amount to be absorbed by the application member. Here, the amount to completely fill the pore space can be determined, in case of the ink-receiving layer made of fine particles, considering the porosity of the ink-receiving layer, for example, the oil absorption. By application and rub-in of the agent in such an amount, the pore space in the ink-receiving layer can be filled with the agent with certainty. Specifically, when a silicone oil of the formula (1) is used as the image fastness-improving agent in order to improve the image-fastness of an image formed on the recording medium of which oil absorption is 0.3 ml, sufficient fastness-improvement can be obtained by applying about 0.3 g of the agent followed by rubbing process. This indicates that the effect of the present invention is obtained by filling the pore space of the ink-receiving layer with the agent not only covering the surface of the ink-receiving layer.

The present invention is achieved when all or substantially all the coloring material existing in the ink-receiving layer is in the fastness-improving agent. Thus, so long as this condition is achieved, the amount of the agent to be applied may be less than the oil absorption amount.

Next, how to carry out the present invention is explained specifically. The present invention can be realized by using a fastness-improving kit comprised of a container containing the agent for applying the agent and a member for rubbing. For example, FIG. 5 shows a dispenser 5003 provided with means 5001 (spray or pump) for delivering a proper amount of the agent to the ink-receiving layer.

According to another embodiment of the present invention, application of the agent and rubbing treatment are carried out at the same time by using an applicator as shown in FIGS. 4A and 4B, in which a storage part 4001 containing the agent and an application member 4002 are integrated and the agent can ooze from the storing part to the surface of the application member. The applicator may have such a constitution that when the agent in the application member 4002 decreases, the agent is supplied into the application member by pressing the storing part 4001. Reference numeral 4003 denotes a lid of 4002. In order to obtain the printed product excellent in image fastness, the method according to the present invention uses a combination of the above-described recording medium and the above-described agent, which gives images of high fastness and easily.

(2) Another embodiment of the method for producing the recorded matter or for improving image fastness according to the present invention is to process the recorded matter in a recording apparatus automatically without hands. FIG. 6 is a schematic sectional view of such an apparatus having means for recording images on the recording medium by ink-jet and means for processing the recorded matter to give excellent image fastness. In FIG. 6, the reference numeral 25 denotes a housing, the reference numeral 1 denotes the unused recording medium piled and laid almost horizontally in a supply tray 2 (a paper-feeding cassette). The reference numeral 3 denotes a suction cup which can move from a position (a) to a position (b) to contact with the uppermost sheet in the tray 2 by the action of a suction cup-moving mechanism (not shown). A suction mechanism (not shown) reduces the pressure in the suction cup when the cup contacted the uppermost sheet to lift and separate it from other sheets, then the suction cup moves to position (c) to transport the sheet to the position (c) and inserts the sheet between feed rollers 4 and 5. After that, suction was stopped to release the sheet.

The carrying rollers 4 and 5 are rotated by a driving source such as a carrying motor (not illustrated) through a crutch mechanism (not illustrated). Reference numerals 6 and 7 denote guide boards and arranged oppositely with a predetermined distance and form a path for supplying the recording paper carried by rotation of the carrying rollers 4 and 5. A sectional shape of the supply path formed by these guide boards 6 and 7 is almost semicircular extending from a place near the carrying rollers 4 and 5 to subscanning rollers 8 and 9 located in an upper position. These subscanning rollers 8 and 9, together with a second pair of subscanning rollers 10 and 11 arranged in parallel to a left-hand direction in the drawing, hold the recording paper carried in and feed under control by a controlling part (not illustrated) mentioned later. Reference numeral 15 denotes the guide board regulating the position of the recording paper between subscanning rollers 8, 9, 10, and 11. Reference numeral 12 denotes a recording head (an ink jet head), in that a plurality of nozzles for ink discharge is arranged in the carrying direction of the recording paper 1. For reference, this recording head 12 may have a plurality of ink jet heads of which each discharges ink of different colors. Reference numeral 13 denotes an ink tank in which ink is contained to be supplied to the recording head 12. The recording head 12 and the ink tank 13 are mounted on a carriage, and by a carriage guide arranged in parallel to a rotation shaft of the subscanning rollers 8 to 11, held movably in an almost orthogonal direction to a carrying direction of the recording paper.

Reference numeral 16 denotes unused second recording paper housed in the upper supply tray. Reference numeral 17 denotes a press board to lightly press the recording paper 16 stacked thereon to the direction of a separating roller 18. Reference numerals 19 and 20 denote the guide boards and form a second supply path to lead the front end of a recording sheet taken out by the separating roller 18 to the subscanning rollers 8 and 9.

Reference numerals 21, 22, 23, and 24 denote, for example, means as disclosed by Japanese Patent Application Laid-Open No. 1-264879 for detecting presence or absence and quality of each recording papers 1 and 16. Reference numerals 21 and 23 denotes light sources to radiate light of a predetermined wavelength on the surface of the recording papers 1 and 16 and reference numerals 22 and 24 denote photo detectors to receive the light reflected by the surface of the recording paper, respectively.

Quality of the recording paper can be determined by reflection light on the basis that coarseness of the surface differs according to the kind of the recording paper resulting in different diffraction. For example, the surface of a normal paper is microscopically made by entangling fibers and diffraction of the light on the surface is large. Therefore, output from detectors 22 and 24 become small. On the other hand, when the surface is smooth and light diffraction is low, output from the detectors 22 and 24 become large. By using such means for detection by light, it can be determined that whether the first separation mechanism using the suction cup 3 or the recording paper matching the second separation mechanism using the separation roller 18 is installed or not in a matched cassette, respectively, or whether the recording paper suitable for recording has been mounted or not.

Reference numerals 26 and 27 denote the guide boards forming a carrying path for leading the recording paper discharged according to rotation of the subscanning rollers 10 and 11 after the recording by the recording head 12 to the next step. To the guide board, a plate heater (not illustrated) has been attached to heat the recording paper in the carrying path formed by the guide boards 26 and 27 to accelerate drying of ink on the recording paper.

Then to the recording face of the thus obtained recorded matter, the image fastness-improving agent is supplied to form a region filled with the image fastness-improving agent in the ink-receiving layer of the recorded matter.

Reference numeral 52 denotes the image fastness-improving agent according to the present invention, which is supplied from the tank not illustrated to a container 51 by a supply apparatus not illustrated, and the level of the liquid 52 in the container 51 is automatically controlled to be in a predetermined range. Reference numeral 53 denotes a roller for applying the agent, and its surface portion 53*a* has as a spongy structure and is in contact with the agent 52 in the container 51 at one portion allowing permeation of the agent 52. When the roller 53 is rotated by the driving source not illustrated, the agent 52 penetrates uniformly into the surface 53*a*. Reference numeral 54 is a carrying roller for carrying the recording medium by holding it in cooperation with the application roller 53. In this case, it is preferable that the carrying roller 54 is separated from the application roller 53 unless the recording medium is present between them to prevent the agent 52 from attaching to the surface of the roller 54. Reference numeral 55 is a dryer heater used for drying the recording medium to which the agent 52 has been applied.

According to the above-described constitution, when the recording by the recording head 12 is completed, the front end of the recording medium reaches the position between the carrying roller 54 and the application roller 53 before the rear end of the recording paper leaves the second subscanning roller pair 10 and 11. Then the recording medium is held between the roller 54 and the roller 53 and according to the rotation of these rollers 53 and 54, the agent 52 is evenly supplied to one face of the recording medium and rubbed to fill the pore space of the ink-receiving layer. The recording medium impregnated with the agent 52 is subjected to further rubbing processing if necessary and then, discharged from a discharge orifice 34 outside the apparatus by rotation of a paper discharge roller 33.

For reference, in FIG. 6, description has been made with an image recording apparatus in which ink jet recording and the image fastness-improving agent application are performed in the same apparatus. Not limited to this, however, an image recording apparatus with a constitution in which an image-recording part is separated from the agent application part, or an independent apparatus for applying the agent separated from the image forming part, is within the scope of the present invention.

Figure 7:
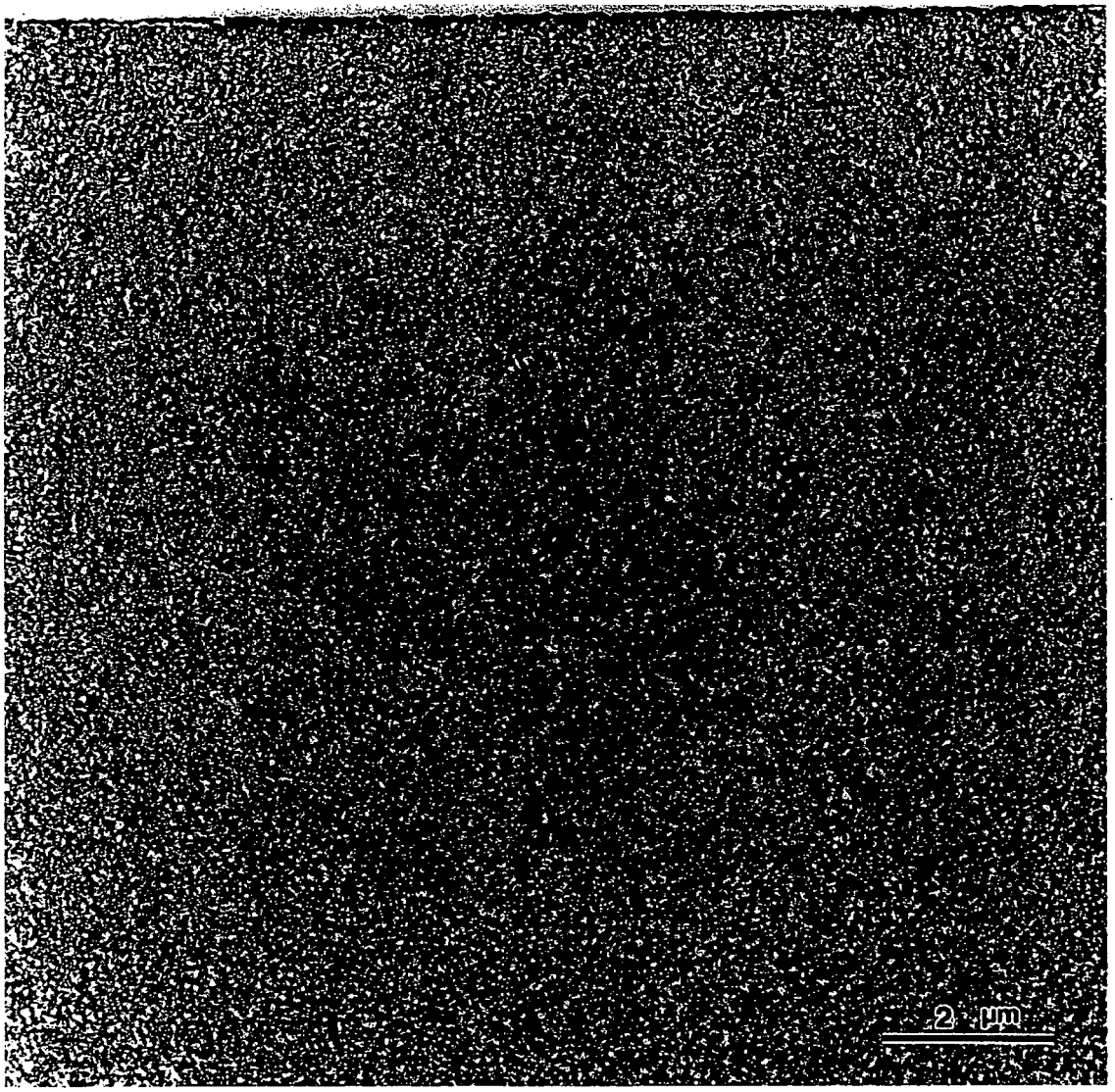
FIG. 7 is a sectional view of the ink-receiving layer of the recording medium usable for the present invention.
Figure 8:
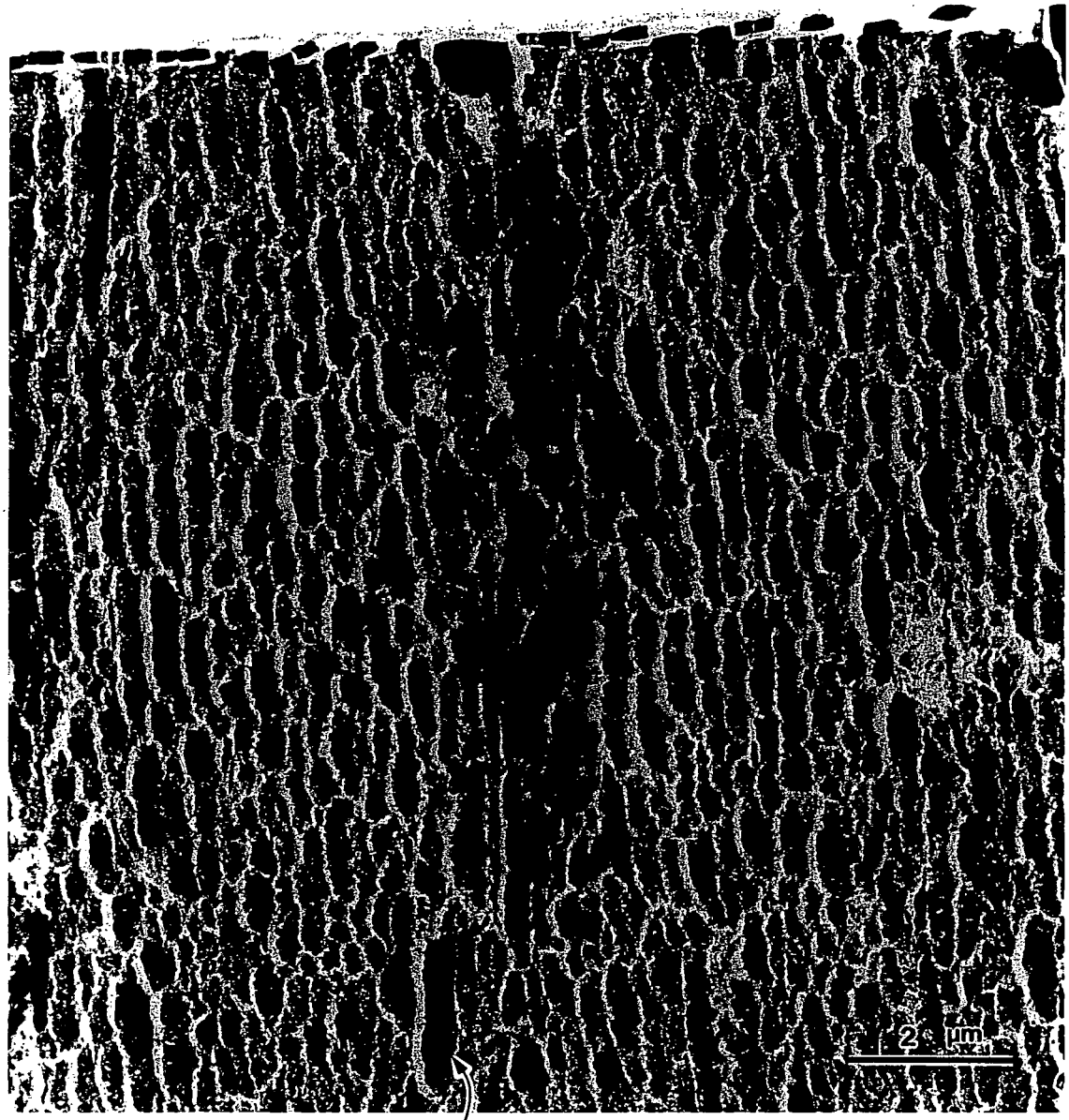
FIG. 8 is a sectional view of an ink-receiving layer of a recorded matter according to the present invention.

In addition, the present inventors observed the sectional structure of the ink-receiving layer of the recorded matter by the electron microscope. The recorded matter had been prepared by using a recording medium having an ink-receiving layer of the porous structure made from fine particles with satisfactory effect of the present invention. As a result, the sectional structure of the recorded matter before applying the fastness-improving agent is as shown in FIG. 7, and the sectional structure after the application of the agent according to the present invention is as shown in FIG. 8. In FIG. 7, the black region is alumina fine particles or aggregates thereof, and white region is the pore space. In FIG. 8, the black region 801 is considered being aggregate of alumina fine particles, and aggregates are oriented along the thickness direction of the ink-receiving layer, in other words, the aggregates are in a shape which is longer along the thickness direction than along the plane direction, and between the aggregates the fastness-improving agent are filled. In other words, the regions filled with the agent are also oriented along the orientation of the aggregates in the thickness direction of the receiving layer. Specifically, the recorded matter shown in FIG. 8 was manufactured by applying the agent composed of a saturated fatty acid ester to a porous ink-receiving layer made of fine alumina particles in an amount sufficient to fill the pore space in the receiving layer on the basis of the porosity of the ink-receiving layer, and then by wiping out the agent.

The reason why application of the agent causes such change of the sectional structure of the ink-receiving layer is not cleared, but the inventors considers as follows.

When the recorded matter of the present invention is prepared, the agent is applied to the ink-receiving layer to penetrate in the thickness direction of the ink-receiving layer. It is presumed since the fatty acid ester in the agent has affinity to the alumina fine particles constituting the ink-receiving layer, when the agent penetrates, the alumina fine particles also migrate, drawn by the agent, to the thickness direction of the receiving layer. Since no change of the image is observed after the filling with the agent, it is considered that this migration occurs at an extremely micro level.

In addition, it is presumed that as a result of active application of the agent to the ink-receiving layer by wiping or polishing, the agent permeates deeply into the ink-receiving layer, which causes migration of alumina fine particles therein to change the shape of the pore space in the ink-receiving layer gradually. In other words, the pore space that were uniformly distributed in the ink-receiving layer before the application of the agent changes gradually to form flow paths for the agent extending from the surface in the thickness direction during penetration of the agent, and finally, this pore space filled with the agent forms the structure as shown in FIG. 8.

Figure 10:
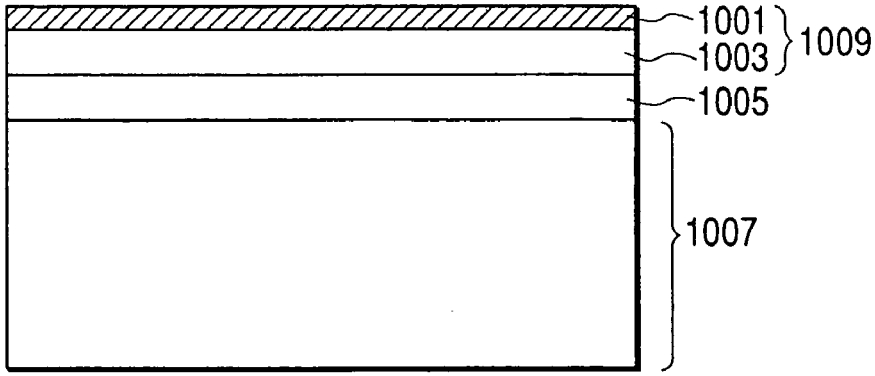
FIG. 10 is a sectional view of a recorded matter recorded on a recording medium usable in the present invention, before application of the fastness-improving agent.

Moreover, the present inventors observed that the coloring material adsorbed by alumina fine particles exist comparatively near the surface of the ink-receiving layer before application of the agent (FIG. 10, 1001), but after the application of the agent, the region 1001 of adsorbed coloring materials disappeared. This phenomenon indicates that migration of coloring material also occurs with the penetration of the agent in the ink-receiving layer. In FIG. 10, the reference numeral 1003 denotes a region where the coloring material adsorbed to the fine particles does not exist and together with the region 1001 forms the ink-receiving layer 1009. The numeral 1005 denotes the dense porous layer formed on the substrate 1007. The inventors of the present invention presumes that the coloring material also moves into the ink-receiving layer as the agent fills the pore space, and surrounded by the agent, which inhibits contact with gas or air at a higher level to achieve excellent improvement in image fastness. Usually migration of the coloring material into the ink-receiving layer results in reduced print density, because the coloring material present deep in the ink-receiving layer would not participate in coloring of the image. On the other hand, in the present invention, regions filled with the agent are formed in the thickness direction of the receiving layer as shown in FIG. 8, and the agent and the alumina fine particles have little difference in the refraction index. Hence, the coloring material existing deep in the ink-receiving layer also contributes to coloration of the image, resulting in improvement of print density as well as image fastness.

Figure 9:
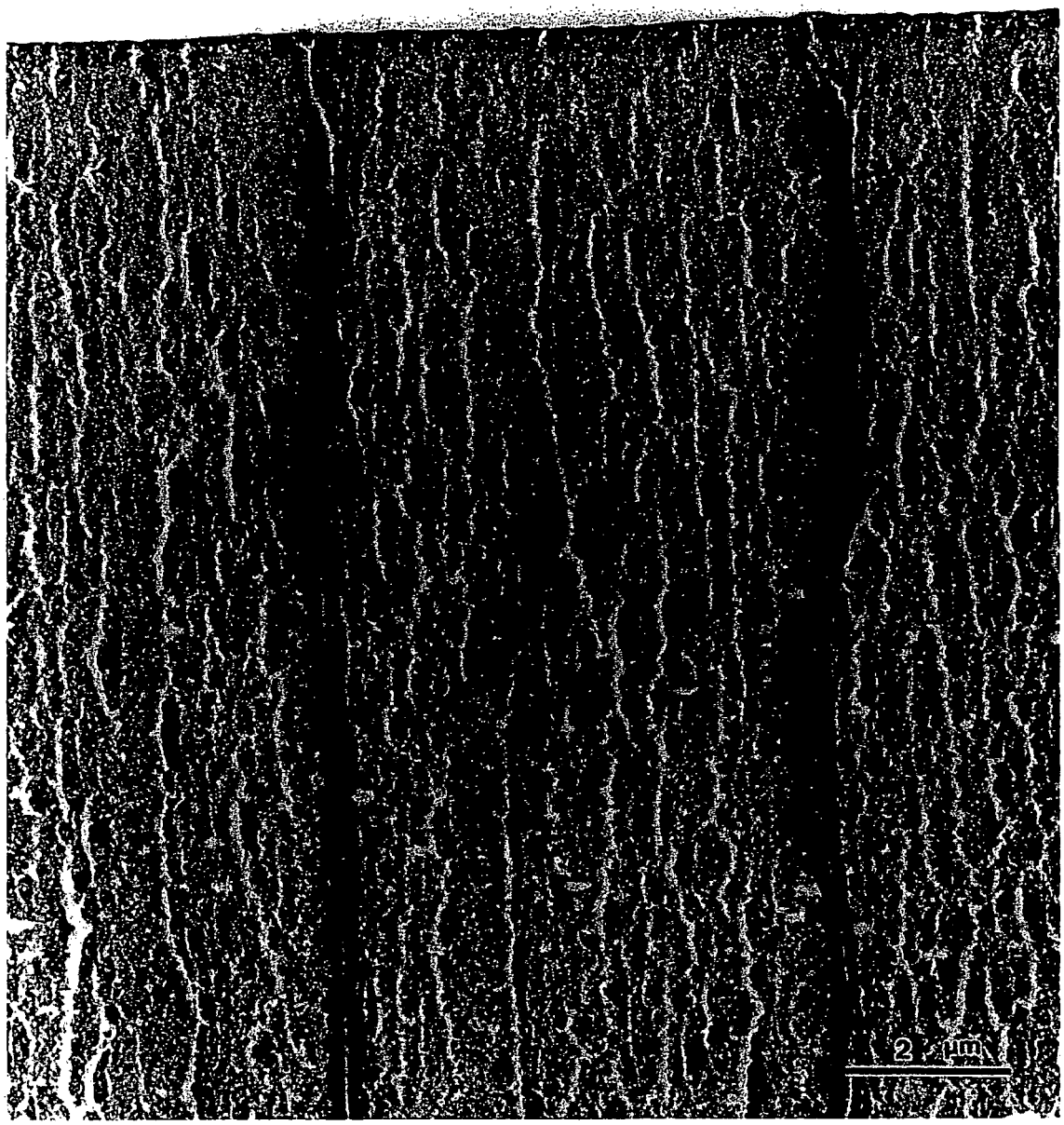
FIG. 9 is another sectional view of an ink-receiving layer of a recorded matter according to the present invention.

Shape and form of the region filled with the agent may vary according to the affinity of the fine particles with the agent, physical properties such as viscosity of the agent, and the method of filling. Thus, a recorded matter of another embodiment was prepared by using a recording material having a porous ink-receiving layer of silica and an agent mainly containing silicone oil. The agent was applied to the ink-receiving layer in an amount sufficient to fill the pore space in the ink-receiving layer based on the porosity of the ink-receiving layer, followed by wiping treatment. The resultant recorded matter was observed as above to show it has a sectional structure shown in FIG. 9, which is similar to that shown in FIG. 8.

EXAMPLES

The present invention will be further described with reference to Examples and Comparative Examples below.

Examples 1 to 11 and Comparative Examples 1 to 4

(Preparation of the Image Fastness-improving Agent)

The image fastness-improving agent of the Examples 1 to 11 and compounds of Comparative Examples 2 to 4 were prepared by mixing at least one of silicone oil and a saturated fatty acid ester, and a hindered amine compound being in a liquid state at normal temperature, in respective ratios shown in Table 2-1, Group A: Silicone Oils and Saturated Fatty Acid Esters A-1: Dimethyl Silicone Oil SH200 (Toray-Dow Corning Silicon Corp.)

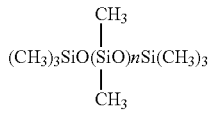

A-2. Fluorine-modified Silicone Oil FS1265 (Toray-Dow Corning Silicon Corp.)

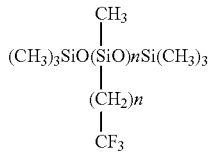

A-3. Alkyl-modified Silicone Oil SF8416 (Toray-Dow Corning Silicon Corp.)

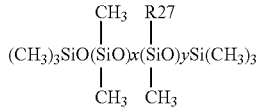

A-4. Saturated Fatty Acid Ester of Neopentyl Polyol

Commercial name: Unistar H-334R (NOF Corp.)

A-5. Saturated Fatty Acid Ester of Neopentyl Polyol

Commercial name: Unistar C-3371A (NOF Corp.)

A-6

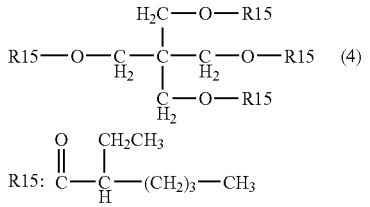

A-7

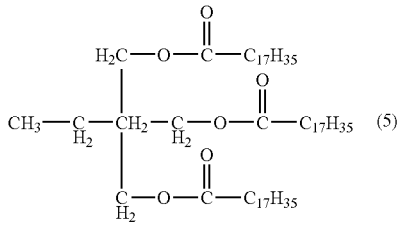

Group B: Hindered Amine Compounds Being Liquid at Normal Temperature

B-1. Commercial Name: Tinuvin 123 (Ciba-Geigy Corp.)

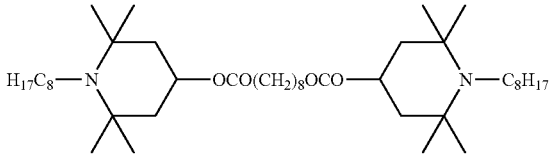

B-2. Commercial name: Tinuvin 292 (Ciba-Geigy Corp.)

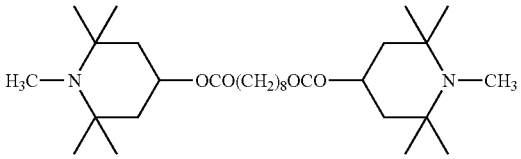

B-3. Commercial name: Adekastab LA-62 (Asahi Denka Kogyo K. K.)

This compound has a structure expressed by the above described formula (7), in which at least one of R5 to R8 is the group expressed by the following structure, others are $C_{13}H_{27}$—.

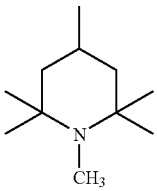

B-4. Commercial name: Adekastab LA-67 (Asahi Denka Kogyo K. K.)

This compound has a structure expressed by the above described formula (7), in which any one of R5 to R8 is the group expressed by the following structure, others are $C_{13}H_{27}$—.

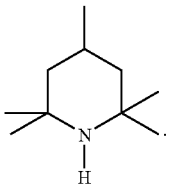

Group C: Additives

C-1

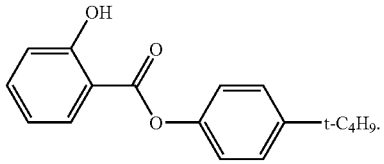

Example of Manufacture of the Recording Medium

Sodium aluminate was added to a solution of 4 wt % aluminum chloride and pH was adjusted to 4. Then, the temperature was raised to 90° C. with stirring and stirring was continued for a while. Then, the sodium aluminate solution was added to adjust pH to 10 and maturation reaction was carried out keeping the temperature for 40 hours. Then the temperature was reduced back to room temperature and the pH was adjusted to 7 to 8. This dispersion solution was desalted and then, deflocculated by using acetic acid to yield a colloidal sol. This colloidal sol of the alumina hydrate was condensed to yield a solution of 17% by weight. Polyvinyl alcohol PVA117 (commercial name; product of Kuraray Corp.) was dissolved in pure water to yield a solution of 9% by weight. The colloidal sol of alumina hydrate and the polyvinyl alcohol solution were mixed and stirred adjusting the ratio of the solid part of alumina hydrate to the solid part of polyvinyl alcohol to 10:1 by weight to obtain a dispersion solution.

B-5

(8)

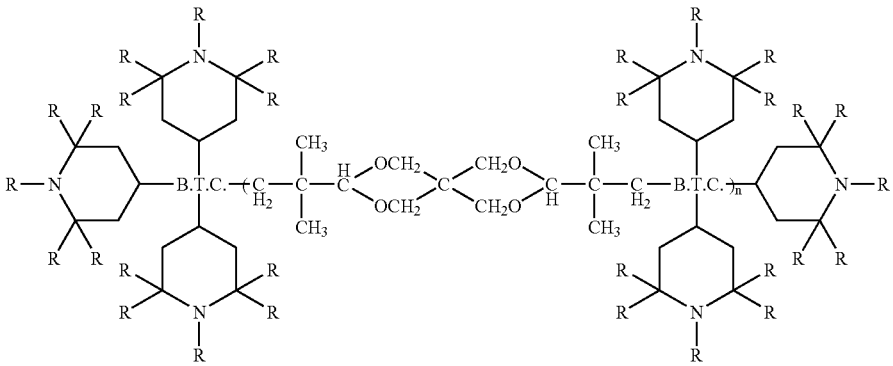

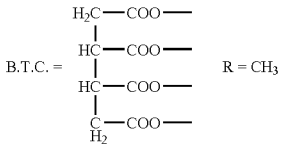

This dispersion solution was applied onto the baryta layer of a substrate (Beck smoothing index 420 sec., whiteness index 89%) to a dry weight of 30 g/m$^2$ by die coating. The substrate was one prepared by applying a baryta composition (gelatin 10 parts by weight and barium sulfate 100 parts by weight) to a fibrous substrate (weight: 150 g/m$^2$, Stoeckigt sizing degree: 200 second) at a dry weight 30 g/m$^2$ and finishing with calendar processing. As above, a recording medium having an ink-receiving layer on the baryta layer of a substrate was prepared. The ink-receiving layer was further subjected to rewet cast processing by using hot water and a rewet cast coater to yield the recording medium. The oil absorbency of the recording medium was about 21 cc/m$^2$.

(Preparation of Recorded Matter and Fastness Processing)

On the recording medium prepared as above, recorded matters having an image recorded thereon were prepared, and the recorded matters were treated with the agents of Examples 1 to 11 and compounds of Comparative Examples 2 to 4 respectively, and then subjected to various image fastness tests according to the following methods I to V. Details are described below. Meanwhile, the recorded matter not received any processing was similarly evaluated as Comparative Example 1.

Ink tanks (commercial names: BCI-6BK, BCI-6Y, M, C, BCI-6PM, and BCI-6PC, made by Canon Inc.) were mounted to an ink-jet photo printer (commercial name: BJ-F870, made by Canon). Using this printer, solid patches of respective colors and densities were formed on the recording face of the recording medium obtained above (single colors: black, cyan, magenta, and yellow, composite colors: composite black, leaf green, flesh tint, and sky blue; density: 100%, 80%, 60%, 40%, 20%, and 10%). The inks used for printing were products of Canon Inc. suitable to the above described printer and were all water-based inks containing water soluble dyes. Subsequently, the above described various image fastness-improving agents and compounds of Comparative Examples 2 to 4 were applied to the surface of the ink-receiving layer of the recorded matters in a ratio of about 0.3 g per a 126 mm×89 mm square, rubbing processing was carried out over the entire face of the image by using a rubbing member made of a natural cotton material to obtain the recorded matters of Examples 1 to 12 and Comparative Examples 2 to 4 was obtained. For each recorded matter, patches of about O. D.=1.0 of each color were subjected to the following image fastness tests.

Evaluation of Light-fastness and Gas-fastness:

Image density of the recorded matter was measured before and after the test by using a spectrophotometer "Spectrolino" (Gretag-MacBeth Corp.). Evaluation of light-fastness and gas-fastness were determined on the basis of the decision standard described below and the results are shown in Table 1.

Test Method

I. Light-fastness Test 1

Following the test conditions described below, the inventors performed a light-fastness exposure test by using a Xenon Fade Meter, simulating indoor effect of solar light through a window.

Test Conditions:

Illumination intensity: 70 klux

Test duration: 100 hr

Temperature and moisture conditions in a test vessel: 24° C., 60% RH

Filter: (outer) soda lime, (inner) borosilicate.

Evaluation of Light-fastness:

With reference to the standard of ISO10977 (1993), evaluation was performed on the basis of residual rate of reflection density (ΔE) after the light-fastness exposure test.

Specifically, with single color patches, the residual rate of reflection density was determined to evaluate following the standards shown in Table 1. On the other hand, concerning the composite color patches formed by superimposing a plurality of color inks, in addition to the residual rate of reflection density of each patch, the residual rate of reflection density of each constitutional color was determined to calculate the difference between the residual rates of reflection density, and evaluation was carried out following the standards shown in Table 1. The reason why the difference of the residual rates of reflection density was added to evaluation of the solid patches of composite color is as follows: the image fastness of the recorded matter of composite color is affected not only by the residual rate of reflection density of the recorded part itself, but also by the degree of fading of each color constituting the composite color in view of visual image quality. In other words, even if the residual rate of reflection density of the recorded part itself is large, if the reflection density of any color constituting the composite color changed largely before and after the test, the color balance in visual observation may be lost to give a feeling of considerable color fading.

In Table 1, for example, residual rate of reflection density being higher than 90% means the lowest residual rate of reflection density in solid patches of black, cyan, magenta, yellow, composite black, leaf green, flesh tint, and sky blue is not less than 90%. Meanwhile, for example, the difference in residual rate of reflection density being lower than 5% means that with solid patches of above four composite colors, the maximum difference of the residual rates of reflection density between colors constituting each composite color is in a range of less than 5%. The difference in residual rate of reflection density being not less than 5% and lower than 10% means that with solid patches of above four composite colors, the maximum difference of the residual rates of reflection density between colors constituting each composite color is in a range of not less than 5% and lower than 10%.

TABLE 1

| | | Residual rate of Reflection Density | | |
|---|---|---|---|---|
| | | 90% or higher | 80% or higher and lower than 90% | Lower than 80% |
| Difference of Residual Rate of reflection density | Less than 5% | A | B | C |
| | 5% or higher and lower than 10% | B | B | C |
| | 10% or higher | C | C | C |

The result of evaluation is shown in Table 2-1 and Table 2-2.

II. Light-fastness Test 2

According to the following test conditions, the light-fastness exposure test was carried out using a fluorescent lamp light-fastness tester, considering the effect of fluorescent lamp light in the room.

Test Conditions:

Illumination intensity: 70 klux

Test duration: 240 h

Temperature and moisture conditions in the test vessel: 24° C., 60% RH

Filter: sodium carbonate

Evaluation of Light-fastness:

With reference to ISO10977 (1993) standard, evaluation of light-fastness was performed on the basis of residual rates of reflection density with the same evaluation criterion as the above described evaluation test (1). The result of evaluation is shown in Table 2-1 and Table 2-2.

III. Gas-fastness Test 1

III-1. According to the following test conditions (ANSI/ISA-S71.04-1985), a gas exposure test was carried out using a fluorescence tube light-fastness tester to test the effect of various gases in the room.

Test Conditions:

Composition of exposure gas: $H_2S$: 10 ppb, $SO_2$: 100 ppb, $NO_2$: 125 ppb, $Cl_2$: 2 ppb, and $O_3$: 25 ppb.

Test duration: 168 hrs

Temperature and moisture conditions in the test vessel: 30° C., 80% RH

Evaluation of Gas-fastness:

Evaluation was performed on the basis of residual rates of reflection density with the same evaluation criterion as above. The result of evaluation is shown in Table 2-1 and Table 2-2.

III-2. According to the following test conditions (ANSI/ISA-S71.04-1985), a gas exposure test was carried out using a gas corrosion tester under the harsher conditions than in III-1. Evaluation was performed following III-1.

Test Condition:

Composition of exposure gas: $H_2S$: 50 ppb, $SO_2$: 300 ppb, $NO_2$: 1250 ppb, $Cl_2$: 10 ppb, and $O_3$: 100 ppb.

Test duration: 240 hrs

Temperature and moisture conditions in the test vessel: 24° C., 60% RH

IV Yellowing Test

The recording medium was treated with the fastness-improving agent of Examples 1 to 11 and the compound of Comparative Examples 2 to 4 in the same manner as described above except that no image was recorded for yellowing test. An untreated sample was prepared as Comparative Example 1. Each sample was left standing in the following environment to compare color tint of the recording face before and after the test.

The result is shown in Table 2-1 and Table 2-2.

Test Conditions:

Temperature and moisture conditions in the test vessel: 50° C., 80% RH

Test duration: 240 hrs

TABLE 2-1

| | A component (%) | | | | | | | B component (%) | | | | | C component (%) | Result of evaluation of image fastness | | | | |
|---|---|---|---|---|---|---|---|---|---|---|---|---|---|---|---|---|---|---|
| Example | A-1 | A-2 | A-3 | A-4 | A-5 | A-6 | A-7 | B-1 | B-2 | B-3 | B-4 | B-5 | C-1 | I | II | III-1 | III-2 | IV |
| 1 | 90 | | | | | | | 10 | | | | | | A | A | A | C | No change |
| 2 | | 100 | | | | | | | | | | | | A | A | A | A | No change |
| 3 | | 90 | | | | | | | 10 | | | | | A | A | A | A | No change |
| 4 | | | 100 | | | | | | | | | | | A | A | A | A | No change |
| 5 | | | 90 | | | | | | | 10 | | | | A | A | A | A | No change |
| 6 | | | | 100 | | | | | | | | | | A | A | A | A | No change |
| 7 | | | | 90 | | | | | | | 10 | | | A | A | A | A | No change |
| 8 | | | | | 100 | | | | | | | | | A | A | A | A | No change |
| 9 | | | | | 90 | | | | | 10 | | | | A | A | A | A | No change |
| 10 | | | | | | 45 | 45 | | | | | 10 | | A | A | A | A | No change |
| 11 | | | | | | 60 | 30 | | | | | 5 | 5 | A | A | A | A | No change |

TABLE 2-2

| Comparative Example | Component contained | Result of evaluation of image fastness | | | | |
|---|---|---|---|---|---|---|
| | | I | II | III-1 | III-2 | IV |
| 1 | - (Untreated) | A | A | C | C | No change |
| 2 | Cationic resin solution | C | C | C | C | Yellowing occurred |
| 3 | Acrylic resin solution | C | C | C | C | Yellowing occurred |
| 4 | Styrene resin solution | C | C | C | C | Yellowing occurred |

V. Glossiness Test

The recording medium was treated with the respective agents of Examples 2 and 10 in the same manner as described above except that no image was recorded for yellowing test. An untreated sample was prepared as Comparative Example 1. After these three samples were kept at the normal temperature for 24 hours, glossiness was measured according to the method of JIS-Z-8741. The result is shown in Table 3.

TABLE 3

| | Example 2 | Example 10 | Comparative Example 1 |
|---|---|---|---|
| 20 degree of gloss | 73.1 | 74.1 | 29.0 |
| 70 degree of gloss | 95.4 | 95.2 | 72.9 |

Recorded matters (100% solid patches) of Examples 2 and 10 and Comparative Example 1 were newly prepared, and left standing at normal temperature for 24 hours, and then, density of each image was measured by using Gretag Spectrolino (Gretag-MacBeth). The result is shown in Table 4.

TABLE 4

| | | Example 2 | Example 10 | Comparative Example 1 |
|---|---|---|---|---|
| Printing Density | Black | 2.45 | 2.41 | 1.98 |
| | Cyan | 2.79 | 2.76 | 2.28 |
| | Magenta | 2.56 | 2.51 | 1.98 |
| | Yellow | 2.15 | 2.12 | 1.80 |

Example 12

Figure 11:
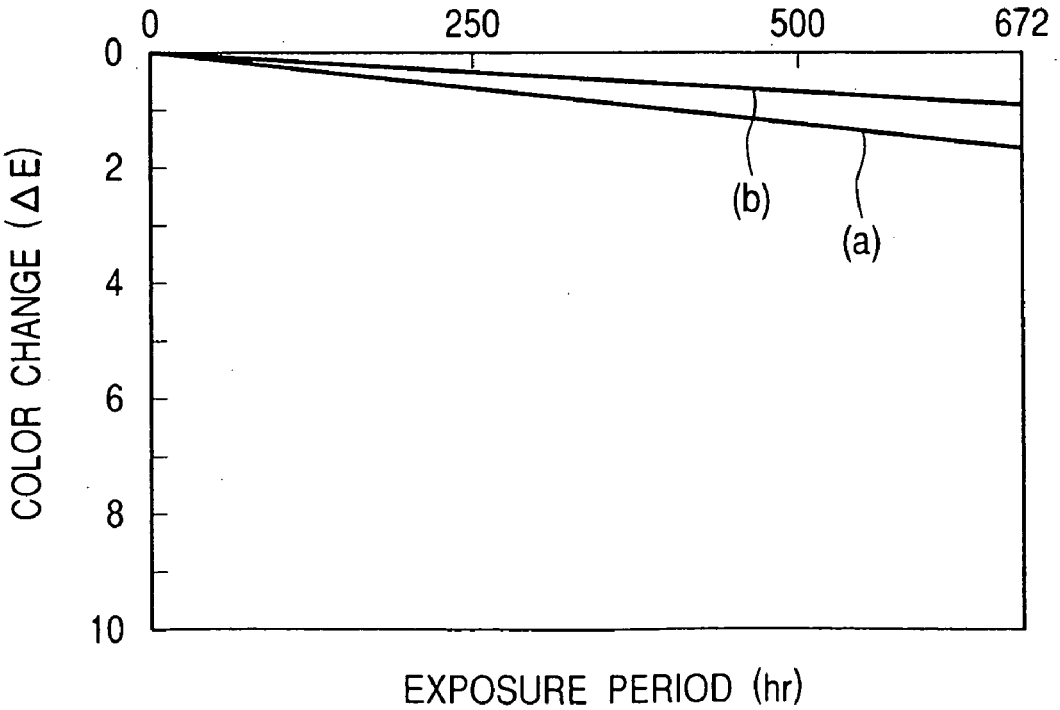
FIG. 11 is a graph to compare gas-fastness between an example of the recorded matter according to the present invention and a recorded matter of silver salt photograph.

Solid patches of composite black were formed on the recording medium by using an ink jet printer (commercial name: BJ-F870, made by Canon Inc.), with respective ink shot amounts of 100%, 80%, 60%, 40%, 20%, and 10%. Next, the solid patches of about O.D. 1.0 were selected and subjected to an exposure test in the same conditions as in the gas-fastness test III-1 except that the duration period was 672 hours, to observe the change in ΔE of each patch. For reference, the result of 504-hour exposure under this environment approximately corresponds to the result of standing in a common room in Tokyo for one year. As a control, print products by ordinary silver salt photography were subjected to the same exposure test to observe ΔE changes of the photographic image. Here, the silver salt photograph samples of composite black were prepared by the Fuji Film digital photography printing system (FDi) (Fuji Photographic Film K. K.), on a color photographic paper (commercial name: Ever Beauty Paper) directly exposing to a laser light followed by development, and those having O. D. of about 1.0 were selected. The result is shown in FIG. 11, where (a) shows the change of ΔE of the printed product by silver salt photography and (b) shows the change of ΔE of the composite black patch according to this invention. As clearly seen from FIG. 11, the printed patches of the composite black according to the present invention show superior gas-fastness to the prints by silver salt photography.

EFFECT OF THE INVENTION

The present invention improves fastness of the ink jet recorded image. Particularly, even when such a recorded matter is displayed in an ordinary indoor environment such as home and office, fading of the image is drastically reduced. Also, the present invention can improve image fastness without spoiling the quality of the recorded image comparable to silver salt photographs such as texture and image quality.

What is claimed is:

1. A method of manufacturing a recorded matter having an ink-receiving layer of a porous structure, the ink-receiving layer having an image region where an image is formed with a coloring material, the method comprising the steps of:

(i) applying an ink to the ink-receiving layer to obtain an image region where an image is formed with a coloring material contained in the ink;

(ii) applying a liquid comprising a non-volatile liquid not dissolving the coloring material to the ink-receiving layer; and (iii) forming a portion in which all or substantially all of the coloring material distributed in a thickness direction of the ink-receiving layer is embedded in the non-volatile liquid by rubbing the non-volatile liquid after it is applied, wherein the non-volatile liquid contains a silicone oil, wherein the non-volatile liquid contains a hindered amine compound having at least one substituent represented by the following structural formula (4):

(4)

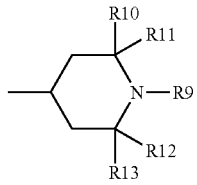

wherein R9 is H or an alkyl group; and R10-R13 are independently a hydrogen atom or an alkyl group having 1 to 3 carbon atoms, and wherein the non-volatile liquid further contains a substance capable of being dissolved or uniformly dispersed in the non-volatile liquid.

2. The method of manufacturing a recorded matter according to claim 1, wherein the porous structure of the ink-receiving layer is formed with fine particles and the coloring material is adsorbed onto the surfaces of the fine particles.

3. The method of manufacturing a recorded matter according to claim 2, wherein the fine particles are made of alumina.

4. The method of manufacturing a recorded matter according to claim 2, wherein the fine particles are made of silicon oxide.

5. The method of manufacturing a recorded matter according to claim 1, wherein the step (iii) comprises a step of filling with the non-volatile liquid all pores or substantially all pores which are present in the thickness direction of the ink-receiving layer in the image region.

6. The method of manufacturing a recorded matter according to claim 1, wherein the silicone oil is a modified silicone oil.

7. The method of manufacturing a recorded matter according to claim 6, wherein the modified silicone oil has a structure represented by the following structural formula (1):

(1)

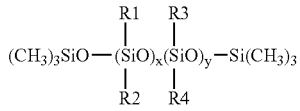

wherein R1, R2, R3 and R4 are independently selected from the group consisting of a phenyl group, a substituted or unsubstituted alkyl group, a halogenated alkyl group, and a functional substituent having a UV absorbency or an antioxidant function; and x and y are independently zero or a positive integer, but both x and y are not simultaneously zero.

8. The method of manufacturing a recorded matter according to claim 6, wherein the modified silicone oil has a structure represented by the following structural formula (2):

(2)

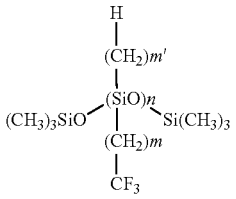

wherein n is an integer from 50 to 600; and m and m' are independently an integer of 1 to 20.

9. The method of manufacturing a recorded matter according to claim 1, wherein the non-volatile liquid further contains a compound represented by the following structural formula (3):

(3)

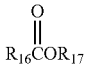

wherein $R_{16}$ denotes an alkyl residue of an isocarboxylic acid having 5 to 18 carbon atoms, and $R_{17}$ denotes an alkyl residue of an isoalcohol having 3 to 18 carbon atoms.

10. The method of manufacturing a recorded matter according to claim 1, wherein the hindered amine compound is a hindered amine compound represented by the following structural formula (5):

(5)

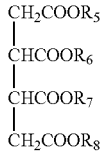

wherein $R_5$-$R_8$ are independently selected from the group consisting of a group represented by the structural formula (4), a hydrogen atom, and a monovalent organic residue, and at least one of $R_5$-$R_8$ is a group represented by the structural formula (4).

11. The method of manufacturing a recorded matter according to claim 1, wherein the hindered amine compound is a chemical compound having at least two substituents represented by the structural formula (4).

12. The method of manufacturing a recorded matter according to claim 1, wherein the hindered amine compound is a compound represented by the following formula (6):

(6)

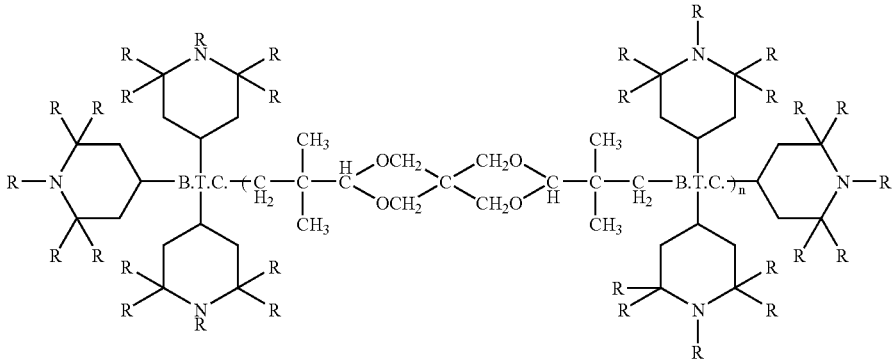

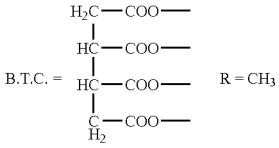

13. The method of manufacturing a recorded matter according to claim 1, wherein the hindered amine compound is a liquid.

14. The method of manufacturing a recorded matter according to claim 1, wherein the substance capable of being dissolved or uniformly dispersed in the non-volatile liquid is at least one of the compounds represented by the following formulas (7) to (14):

(7)

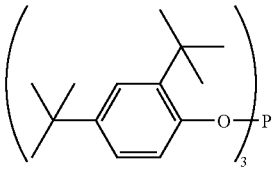

(8)

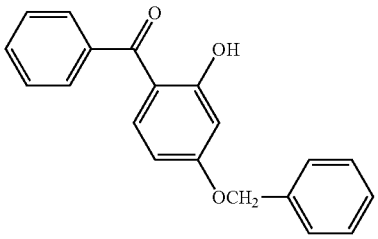

(9)

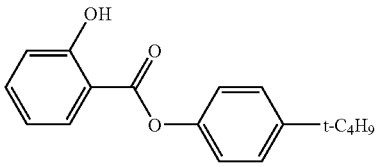

(10)

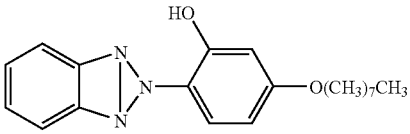

(11)

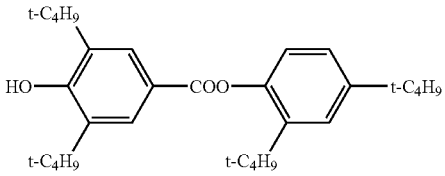

-continued (12)

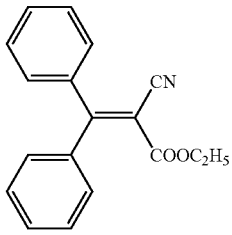

(13)

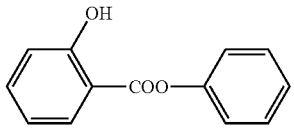

(14)

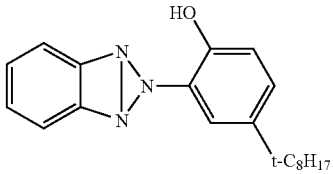

wherein t-$C_4H_9$ is a tert-butyl group and t-$C_8H_{17}$ is a tert-octyl group.

15. The method of manufacturing a recorded matter according to claim 1, wherein the substance capable of being dissolved or uniformly dispersed in the non-volatile liquid is a thickening agent.

16. The method of manufacturing a recorded matter according to claim 1, wherein the ink-receiving layer is provided on a substrate for supporting the ink-receiving layer, and a porous layer is provided between the ink-receiving layer and the substrate.

17. The method of manufacturing a recorded matter according to claim 16, wherein the porous layer contains barium sulfate.

18. The method of manufacturing a recorded matter according to claim 1, wherein a dynamic viscosity of the liquid when the liquid is applied to the ink-receiving layer is 50-600 centistokes.

* * * * *

UNITED STATES PATENT AND TRADEMARK OFFICE

CERTIFICATE OF CORRECTION

PATENT NO. : 7,297,365 B2
APPLICATION NO. : 11/116341
DATED : November 20, 2007
INVENTOR(S) : Takayuki Ishikawa et al.

It is certified that error appears in the above-identified patent and that said Letters Patent is hereby corrected as shown below:

ON THE TITLE PAGE:
At Item (56), References Cited, FOREIGN PATENT DOCUMENTS,
"2000-43408" should read --2000-43406--.

COLUMN 15:
Line 62, "NOx, Sox" should read --$NO_x$, $SO_x$--.
Line 67, "abailable" should read --available--.

COLUMN 18:
Line 41, "crutch" should read --clutch--.

Signed and Sealed this

Second Day of December, 2008

JON W. DUDAS
*Director of the United States Patent and Trademark Office*